US009967690B2

(12) United States Patent
Tsurumi

(10) Patent No.: US 9,967,690 B2
(45) Date of Patent: May 8, 2018

(54) ACOUSTIC CONTROL APPARATUS AND ACOUSTIC CONTROL METHOD

(75) Inventor: Shingo Tsurumi, Saitama (JP)

(73) Assignee: SONY CORPORATION, Tokyo (JP)

( * ) Notice: Subject to any disclaimer, the term of this patent is extended or adjusted under 35 U.S.C. 154(b) by 1055 days.

(21) Appl. No.: 13/274,802

(22) Filed: Oct. 17, 2011

(65) Prior Publication Data

US 2012/0114137 A1 May 10, 2012

(30) Foreign Application Priority Data

Nov. 5, 2010 (JP) ..... 2010-248832

(51) Int. Cl.
*H04R 3/00* (2006.01)
*H04S 7/00* (2006.01)

(52) U.S. Cl.
CPC ..... *H04S 7/303* (2013.01)

(58) Field of Classification Search
CPC ..... H04S 7/303
See application file for complete search history.

(56) References Cited

U.S. PATENT DOCUMENTS 7,415,191 B2 8/2008 Sako et al.
2005/0201565 A1* 9/2005 Choi ..... G06F 3/167 381/61
2007/0127737 A1* 6/2007 Lee ..... H03G 3/32 381/94.3
2009/0304205 A1* 12/2009 Hardacker et al. ..... 381/104
2010/0027832 A1* 2/2010 Koseki ..... H04R 1/323 381/387
2011/0069841 A1* 3/2011 Angeloff et al. ..... 381/17

FOREIGN PATENT DOCUMENTS

JP 2004-312401 11/2004
JP 2008-199449 8/2008

OTHER PUBLICATIONS

"Metadata." Merriam-Webster.com. Accessed Dec. 30, 2014. http://www.merriam-webster.com/dictionary/metadata.*

* cited by examiner

*Primary Examiner* — Joseph Saunders, Jr.
(74) *Attorney, Agent, or Firm* — Paratus Law Group, PLLC

(57) ABSTRACT

Disclosed herein is an acoustic control apparatus including: a speaker-position computation section configured to find the position of each of a plurality of speakers located in a speaker layout space on the basis of a position computed as the microphone position in the speaker layout space based on a taken image of at least any of the microphone and an object placed at a location close to the microphone position, and a result of sound collection to collect a signal sound each generated by one of the speakers; and an acoustic control section configured to control a sound generated by each of the speakers by computing a user position in the speaker layout space based on a taken image of the user, computing the distance between the user position and the position of each of the speakers, and controlling sounds generated by the speakers according to the computed distances.

14 Claims, 20 Drawing Sheets

FIG.11A

| MICROPHONE POSITIONS |
| --- |
| P (x1,y1,z1) |
| Q (x2,y2,z2) |
| R (x3,y3,z3) |

FIG.11B

| SPEAKER | DISTANCE FROM THE MICROPHONE POSITION [m] |
| --- | --- |
| SPEAKER A | \|AP\|=A1 |
| | \|AQ\|=A2 |
| | \|AR\|=A3 |
| SPEAKER B | \|BP\|=B1 |
| | \|BQ\|=B2 |
| | \|BR\|=B3 |
| SPEAKER C | \|CP\|=C1 |
| | \|CQ\|=C2 |
| | \|CR\|=C3 |
| SPEAKER D | \|DP\|=D1 |
| | \|DQ\|=D2 |
| | \|DR\|=D3 |

DETECT A VISUAL MARKER ON THE MICROPHONE TO COMPUTE THE POSITION OF THE MICROPHONE

ATTACH A VISUAL MARKER USABLE FOR COMPUTING A THREE-DIMENSIONAL POSITION TO THE MICROPHONE

SET THE MICROPHONE AT A SPECIFIED POSITION IN THE SPEAKER LAYOUT SPACE

ACOUSTIC CONTROL APPARATUS AND ACOUSTIC CONTROL METHOD

BACKGROUND

The present disclosure relates to an acoustic control apparatus and an acoustic control method.

In recent years, with the progress of the information processing technology, there has been proposed a technology for controlling audios changing in accordance with time and the condition of the listener/viewer.

For example, Japanese Patent Laid-open No. 2008-199449 (referred to as Patent Document 1 hereinafter) given below describes a technology for adjusting the orientation of the display screen of a TV (television) by making use of a swivel mechanism in order to obtain a direction, a video luminance and a volume which are predetermined in advance in accordance with the time at which the power supply of the TV is turned on. In addition, Japanese Patent Laid-open No. 2004-312401 (referred to as Patent Document 2 hereinafter) given below describes a technology for analyzing the condition of the listener/viewer enjoying images and sounds and reducing the volume of the sounds so as not to disturb as the result of the analysis indicates that the listener/viewer starts to pay attention to something other than the images and sounds.

SUMMARY

However, the technologies described in Patent Documents 1 and 2 implement control of an acoustic output in accordance with setting conditions established in advance. That is to say, the technologies do not carry out control of the dynamically changing position of the listener/viewer.

In addition, in recent years, there has been proposed and started a technology for controlling a surround sound system composed of a plurality of speakers, a TV outputting sounds to the speakers and a camera mounted on the TV to serve as a camera for detecting the position of the viewer/listener which is also referred to hereafter simply as the user. This surround sound system is controlled in accordance with the position of the user. Also in the case of such a technology, as a prerequisite, the positions of the speakers and the position of the TV or the camera are known. Without such a prerequisite, it is difficult to apply the technology.

It is thus a desire of the present disclosure, which addresses the problems described above, to provide an acoustic control apparatus capable of monitoring the dynamically changing position of the user and controlling acoustic outputs in accordance with the position of the user. It is also another desire of the present disclosure to provide an acoustic control method for the apparatus.

In order to solve the problems described above, according to an embodiment of the present disclosure, there is provided an acoustic control apparatus including: a speaker-position computation section configured to find the position of each of a plurality of speakers located in a speaker layout space on the basis of a position computed as the position of a microphone in the speaker layout space based on a taken image of at least any of the microphone and an object placed at a location close to the position of the microphone, and a result of sound collection carried out by the microphone to collect a signal sound each generated by one of the speakers; and an acoustic control section configured to carry out control of a sound generated by each of the speakers by computing the position of a user in the speaker layout space on the basis of a taken image of the user, computing the distance between the position of the user and the position of each of the speakers, and controlling sounds generated by the speakers according to the computed distances.

According to another embodiment of the present disclosure, there is provided an acoustic control method, including: computing the position of a microphone in a speaker layout space, in which a plurality of speakers are laid out, on the basis of taken images of at least any of the microphone and an object placed at a location close to the position of the microphone; finding the position of each of the speakers laid out in the speaker layout space on the basis of the computed position of the microphone and a result of sound collection carried out by the microphone to collect signal sounds each generated by one of the speakers; and controlling a sound generated by each of the speakers in accordance with a computed position of the user and the distance from the position of the user to the position of each of the speakers.

As described above, in accordance with the present disclosure, by monitoring the dynamically changing position of the user, an acoustic output can be controlled in accordance with the position of the user.

BRIEF DESCRIPTION OF THE DRAWINGS

FIG. 11A is an explanatory diagram to be referred to in description of a method for computing the position of each speaker in accordance with the embodiment;

FIG. 11B is an explanatory diagram to be referred to in description of a method for computing the position of each speaker in accordance with the embodiment;

DETAILED DESCRIPTION OF THE PREFERRED EMBODIMENTS

Figure 1:
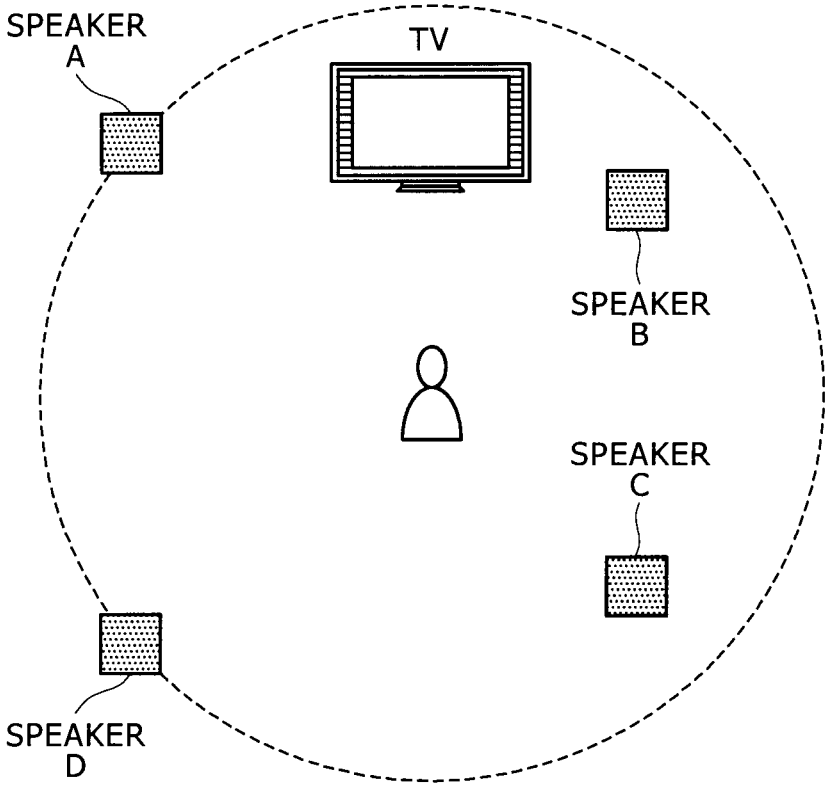
FIG. 1 is an explanatory diagram to be referred to in describing determination of the positions of sound sources.

Preferred embodiments of the present disclosure are described below in detail by referring to the diagrams. It is to be noted that, in the diagrams of the specification of the present disclosure, functional elements having functions identical with each other are denoted by the same reference numeral and such functional elements are explained once in order to avoid duplications of descriptions.

It is also worth noting that the present disclosure is explained in chapters arranged as follows.

(1): Outlines of Acoustic Control Apparatus and Acoustic Control Method (2): First Embodiment (2-1): Surround-sound Adjustment System (2-2): Configuration of Acoustic Control Apparatus (2-3): Typical Concrete Method for Computing Speaker Positions (2-4): Typical Modified Methods for Computing Microphone Position (2-5): Microphone Types (2-6): Flows of Acoustic Control Method (3): Hardware Configuration of Acoustic Control Apparatus According to Present Embodiment

(1): Outlines of Acoustic Control Apparatus and Acoustic Control Method

Figure 2:
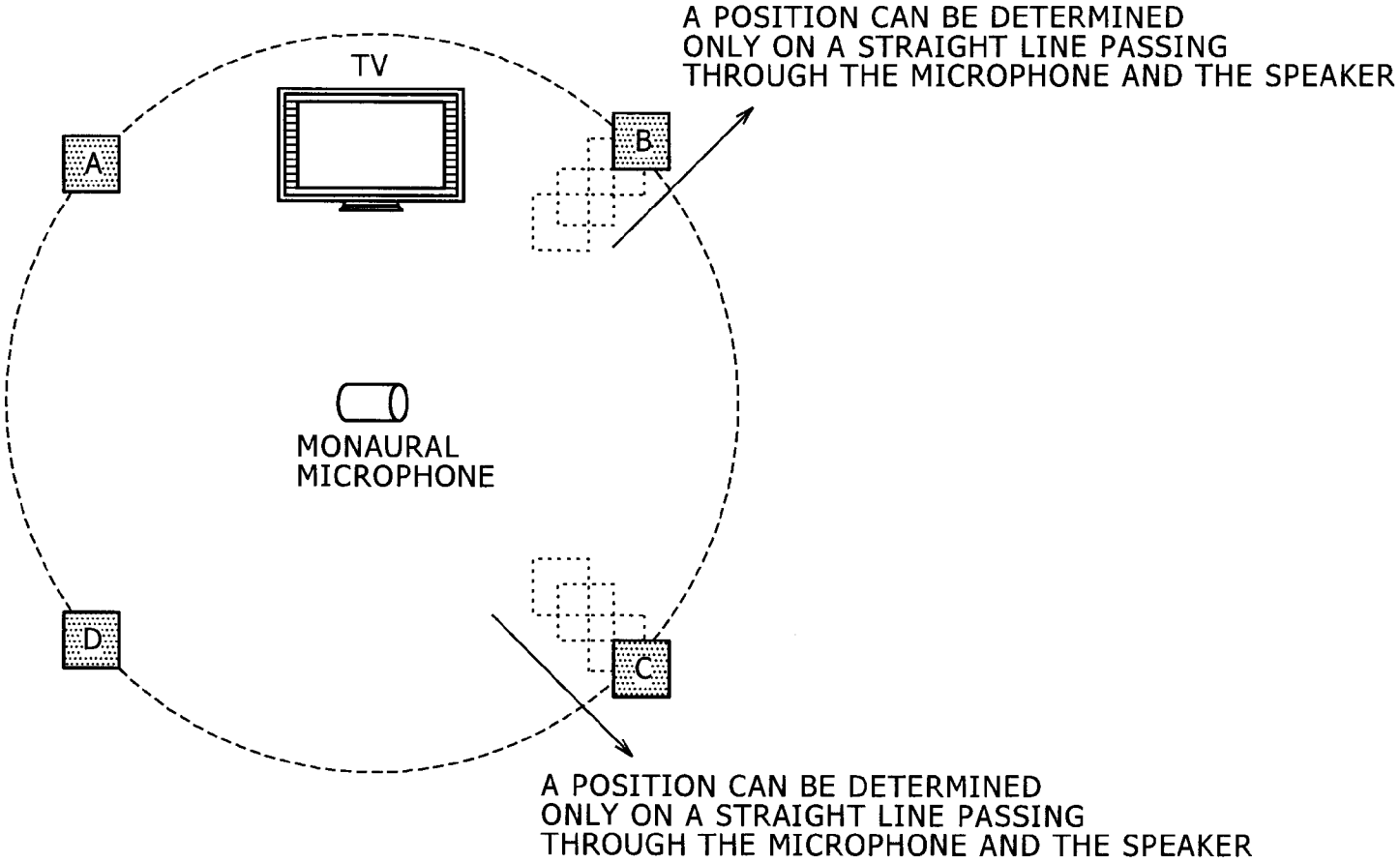
FIG. 2 is an explanatory diagram to be referred to in describing determination of the positions of sound sources.
Figure 3:
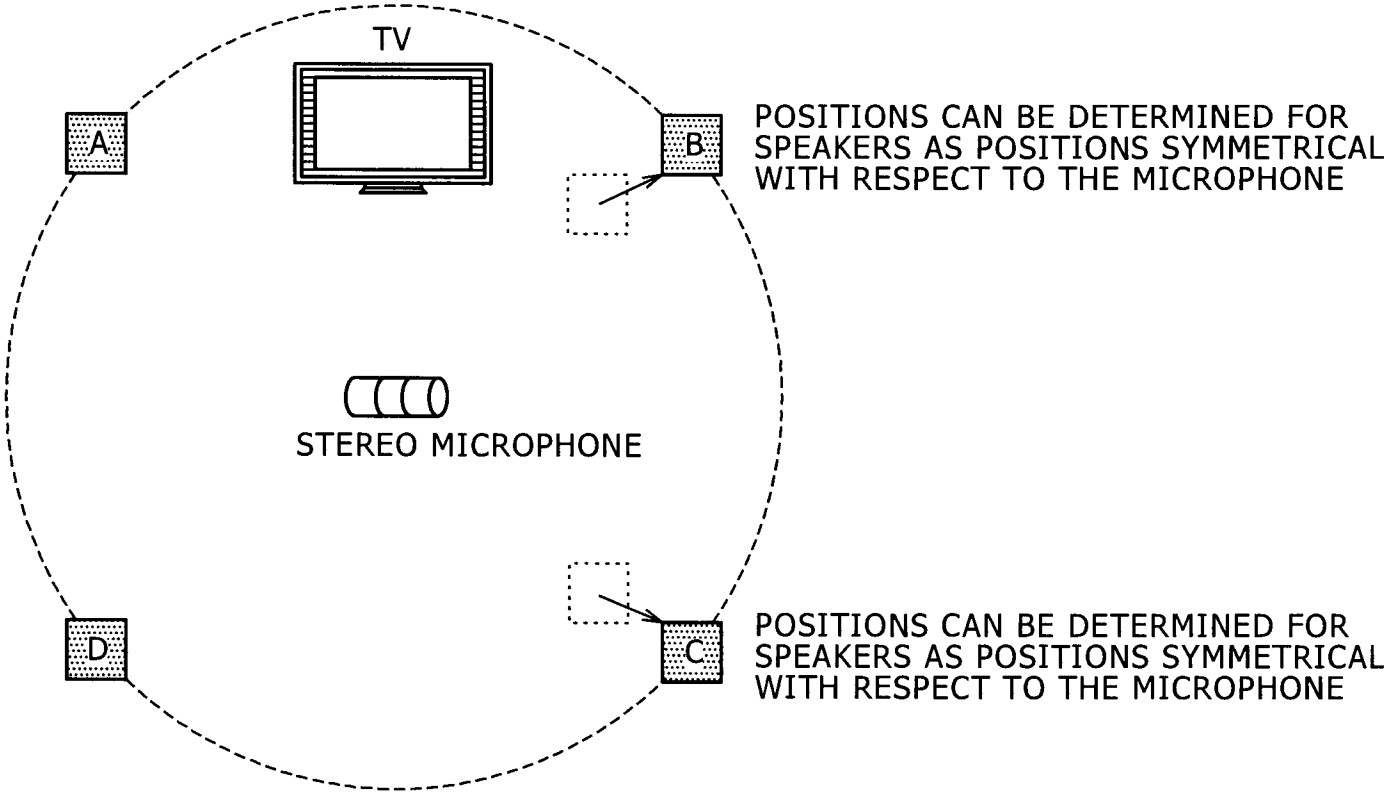
FIG. 3 is an explanatory diagram to be referred to in describing determination of the positions of sound sources.
Figure 4:
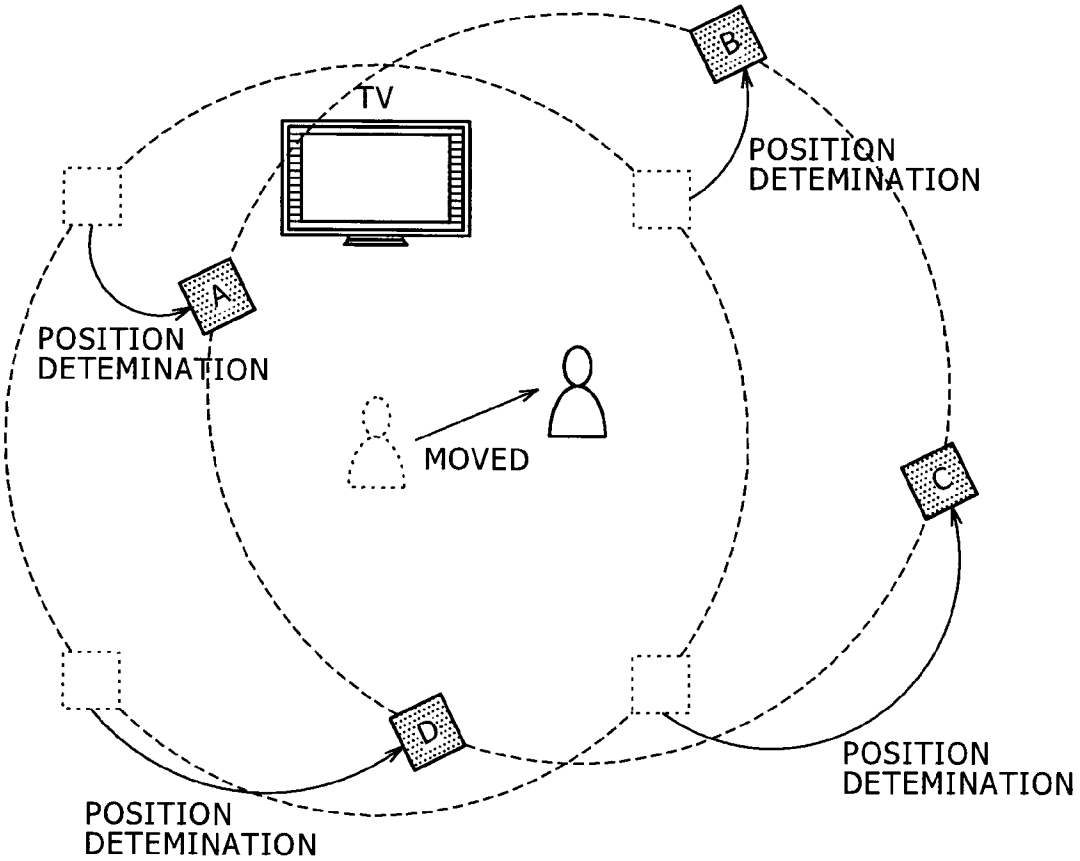
FIG. 4 is an explanatory diagram to be referred to in description of a surround-sound adjustment system according to an embodiment of the present disclosure.

Prior to explanation of an acoustic control apparatus according to an embodiment of the present disclosure and an acoustic control method provided for the acoustic control apparatus, outlines of the acoustic control apparatus according to the embodiment of the present disclosure and the acoustic control method provided for the acoustic control apparatus are briefly described by comparing the acoustic control apparatus and the acoustic control method with the related-art method for determining the position of each sound source. FIGS. 1 to 3 are each an explanatory diagram referred to in the following description of determination of the positions of sound sources. FIG. 4 is an explanatory diagram referred to in the following description of a surround-sound adjustment system according to an embodiment of the present disclosure.

The so-called home theater has been becoming popular. In the home theater, a TV and a plurality of speakers placed at locations surrounding the TV are used for viewing and listening to a TV broadcast or a content composed of images and sounds recorded on a disk such as a DVD (Digital Versatile Disk) or a Blu-Ray disk.

As shown in FIG. 1 for example, four surround speakers each also referred to hereafter simply as a speaker are placed at locations surrounding a TV. In this case, proper positions of the four speakers are positions on the circumference of a circle having a center coinciding with the position of the user. Depending on the size and the shape of the installation area in which the speakers are placed, the speakers may not be actually placed at positions proper for the position of the user as shown in FIG. 1. If the speakers are not be actually placed at positions proper for the position of the user, there is raised a problem that the balance of surround sounds inevitably collapses.

In order to solve the problem described above, there has been proposed and started a technology for calibrating surround sounds by setting a microphone for collecting the sounds generated by the speakers at the position of the user. This technology is a technology for setting a sound output by each speaker at a position proper for the user position at which the microphone is installed. By setting sounds of the speakers in this way, the user is capable of hearing the sounds in an optimum surround environment by viewing and listening to the content at the position, at which the microphone is installed, in spite of the fact that the installation positions of some speakers are not physically proper for the position of the user.

As methods based on such a surround-sound calibration technology, there are provided a method making use of a monaural microphone as typically shown in FIG. 2 and a method making use of a stereo microphone as typically shown in FIG. 3.

In the method making use of a monaural microphone as shown in FIG. 2, due to the characteristic of the sound collection utilizing the monaural microphone, the position of a sound source can be determined on a straight line passing through the microphone and a speaker serving as the sound source. That is to say, the position of the sound source can be moved one-dimensionally along the line passing through the microphone and the speaker serving as the sound source.

In the case of the method making use of a stereo microphone as shown in FIG. 3, on the other hand, sounds can be collected in a stereo manner. Thus, the position of the sound source implemented by a speaker can be moved two-dimensionally in a direction identified as a direction relative to the stereo microphone. As a result, the position of the sound source can be determined on a plane so that the positions of the four speakers become symmetrical with respect to the position of the user, that is, the position of the stereo microphone.

In addition, by making use of a multi-channel microphone capable of collecting sounds from three or more channels, the position of a sound source can be determined not only on a plane, but also three-dimensionally.

However, such a surround-sound calibration technology raises a problem that, if the user views and listens to a content at a location other than the installation position of the microphone, the balance of surround sounds inevitably collapses.

It is thus a desire of the present disclosure, which addresses the problems described above, to provide an acoustic control method to be described below as a method resulting from an earnest study of technologies each capable of monitoring the dynamically changing position of the user and controlling an acoustic output in accordance with the position of the user. As shown in FIG. 4, changes of the position of the user are monitored and the position of a sound source is changed dynamically. It is thus possible to provide the user with surround sounds having good balance without regard to the viewing/listening position of the user any time.

(2): First Embodiment (2-1): Surround-Sound Adjustment System

Figure 5:
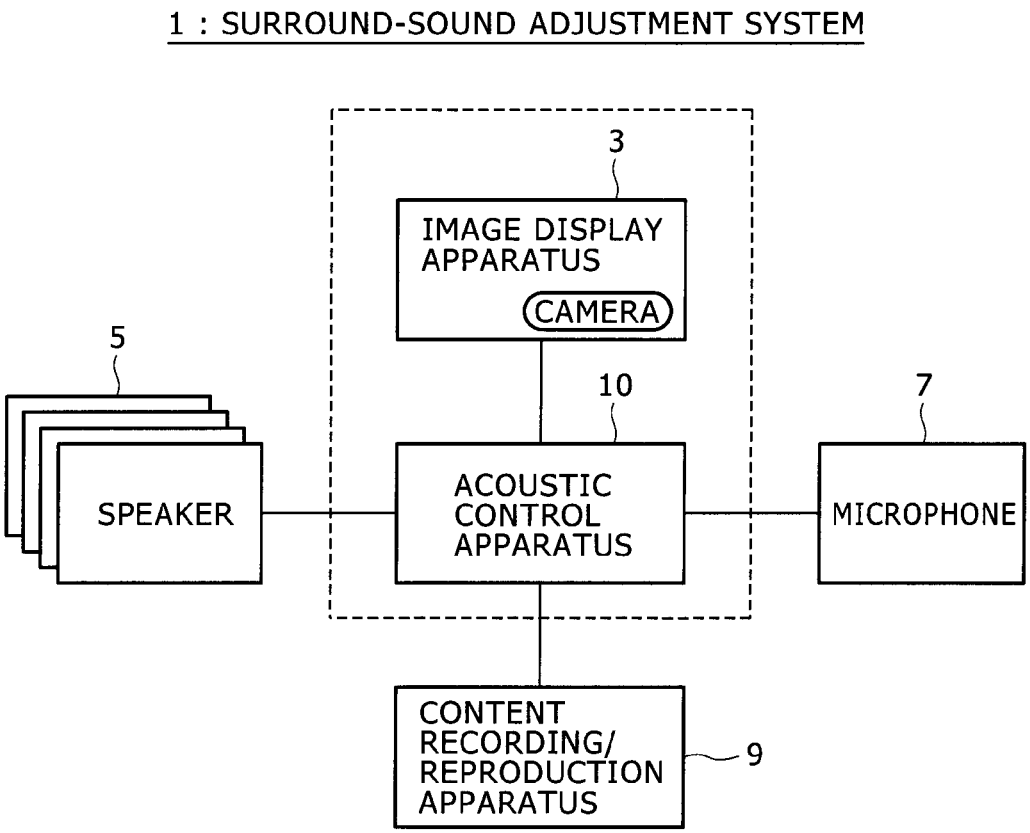
FIG. 5 is an explanatory block diagram to be referred to in description of a typical surround-sound adjustment system according to the embodiment.

First of all, a surround-sound adjustment system 1 according to a first embodiment of the present disclosure is explained by referring to FIG. 5 as follows. FIG. 5 is an explanatory block diagram referred to in the following description of a typical surround-sound adjustment system 1 according to the embodiment.

As shown in FIG. 5, the surround-sound adjustment system 1 according to the embodiment has an image display apparatus 3 for displaying an image content and an acoustic control apparatus 10. A typical example of the image display apparatus 3 is a TV.

The image display apparatus 3 is an apparatus capable of displaying an image content of a content including images and sounds. In addition, on the image display apparatus 3, a camera is provided. The camera is capable of taking an image of the surroundings of the image display apparatus 3. The camera can be a video camera capable of taking moving and static images or a still camera capable of taking static images. An image taken by such a camera is output to the acoustic control apparatus 10 according to the embodiment.

The following description explains a typical configuration in which a camera capable of taking an image of the surroundings of the image display apparatus 3 is provided on the image display apparatus 3 as described above. However, the surround-sound adjustment system 1 according to the embodiment is by no means limited to such a configuration. Even if the surround-sound adjustment system 1 may have a configuration having no camera provided on the image display apparatus 3, the surround-sound adjustment system 1 may have a configuration in which the acoustic control apparatus 10 can receive a taken image of a speaker layout space, in which a plurality of speakers are provided, from an external camera.

The acoustic control apparatus 10 is an apparatus for controlling the sounds of the content by adoption of an acoustic control method to be described below and providing the user with surround sounds proper for the user. The acoustic control apparatus 10 is capable of outputting an audio content to a plurality of speakers 5 and acquiring sounds collected by a microphone 7 from the speakers 5. In addition, the acoustic control apparatus 10 according to the embodiment is also capable of acquiring images taken by an image taking apparatus from the image taking apparatus. Typical examples of the image taking apparatus are a variety of cameras installed externally and a variety of portable devices such as mobile phones having the function of a camera.

As shown in FIG. 5, a content recording/reproduction apparatus 9 may be connected to the acoustic control apparatus 10. Typical examples of the content recording/reproduction apparatus 9 are a DVD recorder and a Blu-ray recorder. In addition, a content reproduction apparatus may be connected to the acoustic control apparatus 10. Typical examples of the content reproduction apparatus are a CD (Compact Disk) player, an MD (Mini Disk) player, a DVD player and a Blu-ray player.

In the typical configuration shown in FIG. 5, the acoustic control apparatus 10 is shown as an apparatus separated from the image display apparatus 3 and the content recording/reproduction apparatus 9. It is to be noted, however, that the configuration including the acoustic control apparatus 10 according to the embodiment is by no means limited to such a configuration. For example, the acoustic control apparatus 10 may be integrated with the image display apparatus 3. As another alternative, the acoustic control apparatus 10 is integrated with the content recording/reproduction apparatus 9. In addition, the acoustic control apparatus 10 explained in the following description may be implemented as an apparatus having a function of the image display apparatus 3 and the content recording/reproduction apparatus 9.

(2-2): Configuration of Acoustic Control Apparatus

[Entire Configuration]

Figure 6:
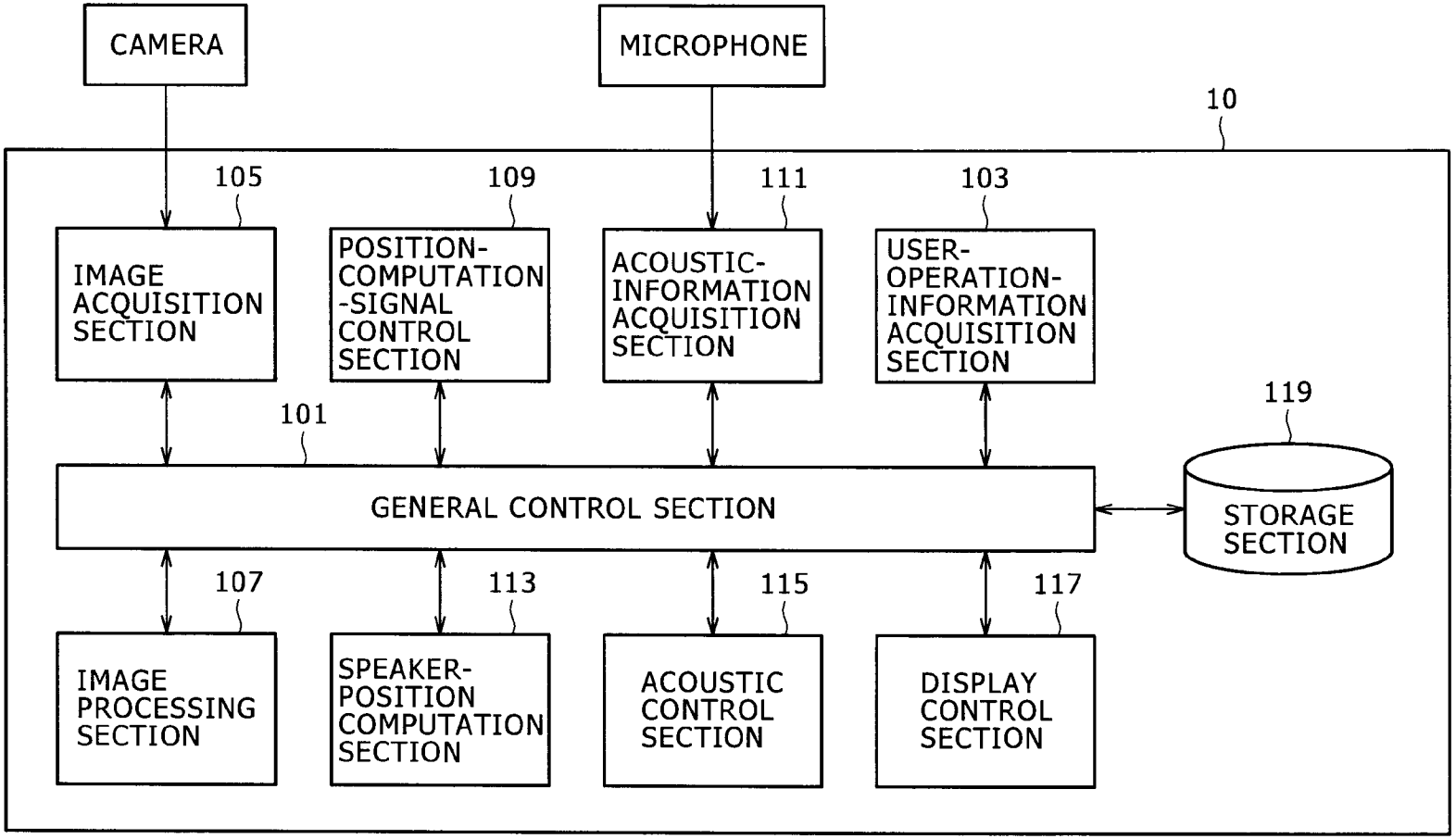
FIG. 6 is a block diagram showing a typical configuration of an acoustic control apparatus according to the embodiment.

Next, the entire configuration of the acoustic control apparatus 10 according to the embodiment is explained by referring to FIG. 6. FIG. 6 is a block diagram showing a typical configuration of the acoustic control apparatus 10 according to the embodiment.

As shown in FIG. 6, the acoustic control apparatus 10 according to the embodiment employs a general control section 101, a user-operation-information acquisition section 103, an image acquisition section 105, an image processing section 107, a position-computation-signal control section 109, an acoustic-information acquisition section 111, a speaker-position computation section 113, an acoustic control section 115, a display control section 117 and a storage section 119.

The general control section 101 typically has a CPU (Central Processing Unit), a DSP (Digital Signal Processor), a ROM (Read Only Memory), a RAM (Random Access Memory) and a communication section. The general control section 101 is a processing section for controlling all operations of the acoustic control apparatus 10 according to the embodiment generally. In addition, the general control section 101 outputs a trigger for starting the operation of every other processing section employed in the acoustic control apparatus 10. Also, the general control section 101 passes on data and information generated in a specific processing section to another processing section. In addition, the general control section 101 also serves as a mediator for driving the other processing sections employed in the acoustic control apparatus 10 according to the embodiment to operate by cooperating with each other.

The user-operation-information acquisition section 103 typically has a CPU, a ROM, a RAM, an input section and a communication section. The user may carry out user operations by typically operating a remote controller provided for the acoustic control apparatus 10 or operating a variety of input keys on a touch panel or buttons of the acoustic control apparatus 10. When the user carries out such a user operation, the user-operation-information acquisition section 103 acquires user-operation information which is information on the operation carried out by the user and outputs the information to the general control section 101. Referring to the user-operation information received from the user-operation-information acquisition section 103, the general control section 101 requests a processing section functioning as a section in charge of the operation carried out by the user to perform processing for the operation.

The image acquisition section 105 typically has a CPU, a ROM, a RAM and a communication section. The image acquisition section 105 acquires data for a taken image of a space in which a plurality of speakers 5 are laid out. In the following description, the space in which a plurality of speakers 5 are laid out is also referred to as a speaker layout space. The taken image of the speaker layout space has been taken by making use of a camera with which the acoustic control apparatus 10 is capable of communicating. As will be described below, a typical example of the taken image of the speaker layout space is a taken image of a microphone placed in the speaker layout space and an object placed at a location close to the position of the microphone. Another typical example of the taken image of the speaker layout space is a taken image of the user present in the speaker layout space.

After the image acquisition section 105 has successfully acquired such a taken image from a camera (for example, a camera mounted on the image display apparatus 3) installed at a location external to the acoustic control apparatus 10, the image acquisition section 105 outputs data for the taken image to the general control section 101. When the general control section 101 receives the taken image from the image acquisition section 105, the general control section 101 passes on the taken image to the image processing section 107. In addition, the general control section 101 may store a variety of taken images received from the image acquisition section 105 in the storage section 119 to be described later as history information by associating each of the taken images with typically information on an image taking date and an image taking time.

The image processing section 107 typically has a CPU, a GPU (Graphics Processing Unit), a ROM and a RAM. The image processing section 107 is a processing section for carrying out various kinds of signal processing on a variety of taken images received from the image acquisition section 105. When the image processing section 107 carries out various kinds of signal processing on a variety of taken images received from the image acquisition section 105, the image processing section 107 is capable of making an access to the storage section 119 to be described later in order to refer to a variety of programs, a variety of databases and a variety of parameters. The image processing section 107 supplies results of the image processing carried out thereby to the general control section 101 which then passes on the results to a variety of other processing sections employed in the acoustic control apparatus 10.

It is to be noted that a detailed configuration of the image processing section 107 according to the embodiment will be additionally described later.

The position-computation-signal control section 109 typically has a CPU, a DSP, a ROM and a RAM. When the general control section 101 starts computation of the positions of the speakers 5 laid out in the speaker layout space, the position-computation-signal control section 109 controls an operation to output a signal used in the computation of the positions of the speakers 5 in accordance with a predetermined trigger received from the general control section 101. In the following description, the signal used in the computation of the positions of the speakers 5 is also referred to as a position computation signal. The position-computation-signal control section 109 controls the operation to output the position computation signal typically in order to drive each of the speakers 5 laid out in the speaker layout space to individually output a predetermined position computation signal such as a beep sound.

It is to be noted that the general control section 101 provides the position-computation-signal control section 109 with a trigger for starting the control of the operation to output the position computation signal typically when the user-operation-information acquisition section 103 provides the general control section 101 with user operation information indicating that the user has operated a predetermined button of the remote controller or the like. Receiving the trigger, the position-computation-signal control section 109 starts the control of the operation to output the position computation signal.

In addition, besides the beep sound, the position computation signal can be any of a variety of signals and the attributes of the position computation signal can be properly set. The attributes of the position computation signal include the frequency of the position computation signal.

The acoustic-information acquisition section 111 typically has a CPU, a ROM, a RAM and a communication section. The acoustic-information acquisition section 111 acquires acoustic information which is information on sounds collected by the microphone connected to the acoustic control apparatus 10. Typical examples of the microphone are a monaural microphone, a stereo microphone and a multi-channel microphone. A typical example of the acoustic information is information on a result of collection of sounds of the position computation signal output individually from each of the speakers 5 by the position-computation-signal control section 109. However, the acoustic information according to the embodiment is by no means limited to the information on a result of collection of such sounds. That is to say, various kinds of information collected by the microphone can be used as the acoustic information. A typical example of information collected by the microphone is the voices of the user.

The acoustic-information acquisition section 111 outputs the acquired acoustic information to the general control section 101. The general control section 101 then passes on the acoustic information to other processing sections selected in accordance with processing to be carried out on the taken image. In addition, the general control section 101 may store various kinds of acoustic information received from the acoustic-information acquisition section 111 in the storage section 119 to be described later as history information by associating the acoustic information with information on an acoustic-information acquisition date and an acoustic-information acquisition time.

The speaker-position computation section 113 typically has a CPU, a ROM and a RAM. The speaker-position computation section 113 computes the position of each of the speakers 5 laid out in the speaker layout space by making use of results of image processing carried out by the image processing section 107 on the taken image generated by the image acquisition section 105 and by making use of results acquired by the acoustic-information acquisition section 111 as results of collection of sounds each represented by a position computation signal output by one of the speakers 5. To put it concretely, the speaker-position computation section 113 computes the position of each of the speakers 5 laid out in the speaker layout space on the basis of the position of the microphone and results of an operation carried out by the microphone to collect signal sounds each output by one of the speakers 5. The position of the microphone has been computed on the basis the taken images of the microphone placed in the speaker layout space and an object placed at a location close to the position of the microphone.

After the speaker-position computation section 113 has computed the position of each of the speakers 5 laid out in the speaker layout space on the basis of such various kinds of information, the speaker-position computation section 113 supplies the obtained result of the computation to the general control section 101. The result of the computation is speaker position information which is information on the position of each of the speakers 5. The general control section 101 then passes on the speaker position information received from the speaker-position computation section 113 to the acoustic control section 115 to be described later. In addition, the general control section 101 may store the speaker position information received from the speaker-position computation section 113 in the storage section 119 to be described later as history information by associating the speaker position information with information on a speaker-position-information acquisition date and a speaker-position-information acquisition time.

It is to be noted that a detailed configuration of the speaker-position computation section 113 according to the embodiment will be additionally described later.

The acoustic control section 115 typically has a CPU, a DSP, a ROM and a RAM. The acoustic control section 115 computes the position of the user present in the speaker layout space on the basis of a taken image of the user. To put it in detail, the acoustic control section 115 computes the position of the user present in the speaker layout space on the basis of a result of processing carried out on a taken image of the user. In addition, the acoustic control section 115 makes use of the computed position of the user to find the distance between the position of the user and the position of each of the speakers 5. Then, in accordance with the computation results, the acoustic control section 115 controls a sound generated by each of the speakers 5.

The acoustic control section 115 controls a sound generated by each of the speakers 5 by carrying out sound-source-position determination processing to determine the position of each sound source serving as a virtual speaker for one of the physical speakers 5 as a position proper for the position of the user and carrying out sound-quality adjustment processing according to the characteristic of the user. A typical example of the characteristic of the user is the metadata of the user. The metadata of the user includes the gender of the user and the age thereof.

It is to be noted that a detailed configuration of the acoustic control section 115 according to the embodiment will be additionally described later.

The display control section 117 typically has a CPU, a ROM, a RAM and a communication section. The display control section 117 controls a display apparatus employed in the acoustic control apparatus 10 according to the embodiment. Typical examples of the display apparatus are a display unit and a display panel. Thus, each processing section employed in the acoustic control apparatus 10 according to the embodiment is capable of showing a message or a display to notify the user that the processing has been completed. Furthermore, each specific processing section is capable of showing a message or a display, which represent a result of the processing, to the user.

In addition, the display control section 117 according to the embodiment is also capable of displaying the processing termination notification informing the user of the end of processing carried out in the acoustic control apparatus 10 as described above and the result of the same processing on an external apparatus such as the image display apparatus 3. Thus, for example, the display control section 117 is capable of displaying the result of the surround-sound calibration processing carried out in the acoustic control apparatus 10 on the display screen of the image display apparatus 3.

The storage section 119 is a typical example of a storage apparatus employed in the acoustic control apparatus 10 according to the embodiment. The storage section 119 is used for storing information such as the speaker-position information which is information on the position of each of the speakers 5 laid out in the speaker layout space. As described earlier, the speaker-position information is computed by the speaker-position computation section 113. In addition, the storage section 119 can also be used for storing various kinds of information and various kinds of data. The information and the data are created in the acoustic control apparatus 10 according to the embodiment. On top of that, the storage section 119 can also be used for storing a variety of parameters and intermediate results required to be saved in the course of processing carried out by the acoustic control apparatus 10 according to the embodiment. Furthermore, the storage section 119 can also be used for properly storing a variety of databases and a variety of programs.

The whole configuration of the acoustic control apparatus 10 according to the embodiment has been explained in detail in the above descriptions.

[Image Processing Section]

Figure 7:
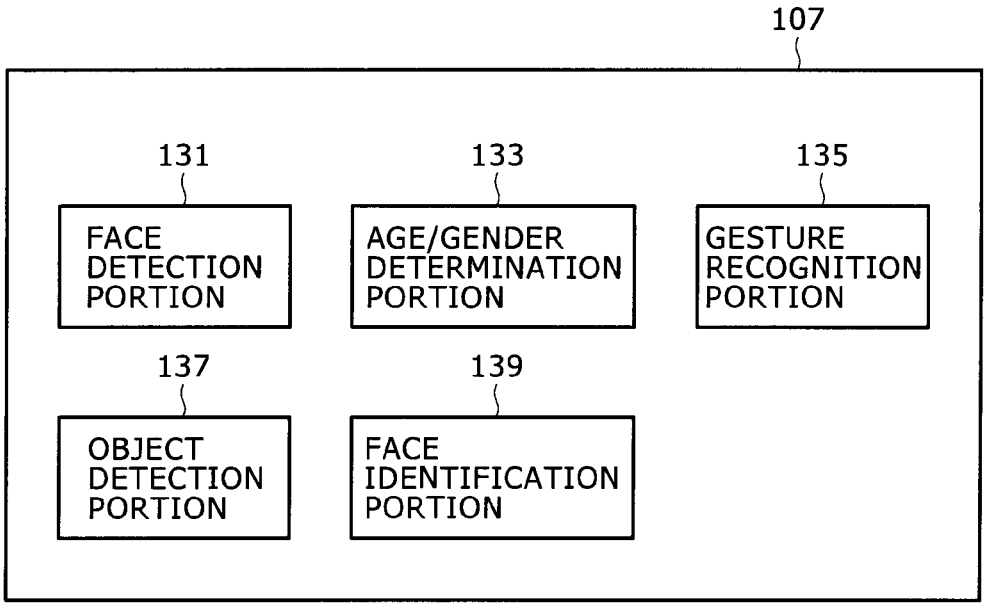
FIG. 7 is a block diagram showing a typical configuration of an image processing section employed in the acoustic control apparatus according to the embodiment.

Next, the configuration of the image processing section 107 employed in the acoustic control apparatus 10 according to the embodiment is explained by referring to FIG. 7. FIG. 7 is a block diagram showing a typical configuration of the image processing section 107 employed in the acoustic control apparatus 10 according to the embodiment.

As shown in FIG. 7, the image processing section 107 employs a face detection portion 131, an age/gender determination portion 133, a gesture recognition portion 135, an object detection portion 137 and a face identification portion 139.

The face detection portion 131 typically has a CPU, a GPU, a ROM and a RAM. The face detection portion 131 carries out face detection processing by referring to a variety of taken images received from the image acquisition section 105 in order to detect a portion corresponding to the face of a person. The taken images include the taken images of the microphone, an object placed at a location close to the position of the microphone and the user. It is quite within the bounds of possibility that the portion corresponding to the face of a person is included in the taken images. If the portion corresponding to the face of a person is included in the taken images, the face detection portion 131 detects the portion corresponding to the face of a person from the taken images and identifies attributes of the portion corresponding to the face of a person. The attributes include the pixel coordinates of the portion corresponding to the face of a person as well as the size of the portion corresponding to the face of a person.

In addition, by carrying out the face detection processing, the face detection portion 131 is capable of determining the number of persons each serving as the user existing in the taken images. If a plurality of persons each serving as the user exist in the taken images, the face detection portion 131 is capable of identifying attributes of the portion corresponding to the face of each of the persons. As described above, the attributes of the portion corresponding to the face of a person include the pixel coordinates of the portion corresponding to the face of the person as well as the size of the portion corresponding to the face of the person. In addition, the face detection portion 131 may compute a variety of characteristic quantities characterizing the group of the users. The characteristic quantities include the position of the center of gravity for a group having the faces of the users.

The face detection portion 131 supplies the detection results of the face detection processing to the general control section 101. The general control section 101 then passes on the detection results to the other processing portions including the speaker-position computation section 113 and the acoustic control section 115. In addition, the face detection portion 131 also supplies the detection results to the other processing portions employed in the image processing section 107 so that the face detection portion 131 is capable of carrying out processing while cooperating with the other processing portions employed in the image processing section 107.

The face detection processing can be carried out by the face detection portion 131 by adoption of any of known relevant technologies such as a technology disclosed in Japanese Patent Laid-open No. 2007-65766 and a technology disclosed in Japanese Patent Laid-open No. 2005-44330.

The age/gender determination portion 133 typically has a CPU, a GPU, a ROM and a RAM. The age/gender determination portion 133 makes use of the face image detected by the face detection portion 131 in order to detect characteristic portions of the face. The characteristic portions of the face include the brows, the eyes, the nose and the mouth. The processing to detect characteristic portions of the face can be carried out by the age/gender determination portion 133 by adoption of any of known relevant technologies including a technology serving as the basis of an AAM (Active Appearance Model) method.

Then, the age/gender determination portion 133 pays attention to characteristic portions of the detected face in order to determine the age of the owner of the face and the gender of the owner. Thus, the age/gender determination portion 133 is capable of extracting information including the age and the gender as metadata of the user. The method for determining the age and the gender by paying attention to the detected characteristic portions of the face can be any method based on any of known relevant technologies.

Then, the age/gender determination portion 133 supplies the determination results to the general control section 101. The determination results are the aforementioned metadata including the age of the user and the gender of the user. Subsequently, the general control section 101 passes on the determination results to other processing portions including the acoustic control section 115. In addition, the age/gender determination portion 133 also supplies the determination results to the other processing portions employed in the image processing section 107 so that the age/gender determination portion 133 is capable of carrying out processing while cooperating with the other processing portions employed in the image processing section 107.

The gesture recognition portion 135 typically has a CPU, a GPU, a ROM and a RAM. The gesture recognition portion 135 pays attention to the taken images received from the image acquisition section 105 and time-lapse changes of the taken images in order to recognize a gesture made by the user included in the taken images. As explained earlier, the taken images include the taken images of the microphone, an object placed at a location close to the position of the microphone, and the user. In this way, the gesture recognition portion 135 is capable of recognizing a specific gesture made by the user. For example, when the user makes a gesture by waving its hand or giving a peace sign with its hands, the gesture recognition portion 135 is capable of recognizing this gesture.

The gesture recognition processing described above can be carried out by the gesture recognition portion 135 by adoption of any of known relevant technologies.

The gesture recognition portion 135 supplies the result of the gesture recognition processing to the general control section 101. Then, the general control section 101 passes on the result of the gesture recognition processing to other processing portions including the acoustic control section 115. In addition, the gesture recognition portion 135 also supplies the result of the gesture recognition processing to the other processing portions employed in the image processing section 107 so that the gesture recognition portion 135 is capable of carrying out processing while cooperating with the other processing portions employed in the image processing section 107.

The object detection portion 137 typically has a CPU, a GPU, a ROM and a RAM. The object detection portion 137 carries out object detection processing by referring to a variety of taken images received from the image acquisition section 105 in order to detect a portion corresponding to a specific object. The taken images include the taken images of the microphone, an object placed at a location close to the position of the microphone, and the user. It is quite within the bounds of possibility that the portion corresponding to the specific object is included in the taken images. Typical examples of the specific object detected by the object detection portion 137 are the microphone itself which is placed at a position in the speaker layout space and a visual marker provided on the microphone. A typical example of the visual marker is a cyber code.

If the portion corresponding to the specific object is included in the taken images, the object detection portion 137 detects the portion corresponding to the specific object from the taken images and identifies attributes of the portion corresponding to the specific object. The attributes include the pixel coordinates of the portion corresponding to the specific object as well as the size of the portion.

In addition, by carrying out the object detection processing, the object detection portion 137 is capable of identifying the number and the type of specific objects shown on the taken images, such as the type of the microphone. If a plurality of specific objects are shown on the taken images, the object detection portion 137 is capable of identifying attributes of the portion corresponding to each of the specific objects. As described above, the attributes of the portion corresponding to a specific object include the pixel coordinates of the portion corresponding to the specific object as well as the size of the portion. In addition, the object detection portion 137 may compute a variety of characteristic quantities characterizing the group having the specific objects. The characteristic quantities include the position of the center of gravity for a group having of the specific objects.

The object detection portion 137 supplies the detection results of the object detection processing to the general control section 101. The general control section 101 then passes on the detection results to other object processing portions including the speaker-position computation section 113 and the acoustic control section 115. In addition, the object detection portion 137 also supplies the detection results to the other processing portions employed in the image processing section 107 so that the object detection portion 137 is capable of carrying out processing while cooperating with the other processing portions employed in the image processing section 107.

The object detection processing can be carried out by the object detection portion 137 by adoption of any of known relevant technologies.

The face identification portion 139 typically has a CPU, a GPU, a ROM and a RAM. The face identification portion 139 is a processing section for identifying a face detected by the face detection portion 131. The face identification portion 139 pays attention to, among others, characteristic portions of the face detected by the face detection portion 131 and computes local characteristic quantities. Then, the face identification portion 139 stores the computed local characteristic quantities by associating the quantities with the image of the face detected by the face detection portion 131 in order to construct a user database. Then, the face identification portion 139 makes use of a user database in order to identify a face detected by the face detection portion 131 as the face of the user.

It is to be noted that the face recognition processing can be carried out by the face identification portion 139 by adoption of any of known relevant technologies such as a technology disclosed in Japanese Patent Laid-open No. 2007-65766 and a technology disclosed in Japanese Patent Laid-open No. 2005-44330.

The face identification portion 139 supplies the recognition results of the object recognition processing to the general control section 101. The general control section 101 then passes on the recognition results to the object processing portions including the acoustic control section 115. In addition, the face identification portion 139 also supplies the recognition results to the other processing portions employed in the image processing section 107 so that the face identification portion 139 is capable of carrying out processing while cooperating with the other processing portions employed in the image processing section 107.

The above descriptions briefly explain the processing portions composing the configuration of the image processing section 107 according to the embodiment by referring to FIG. 7. In addition to the processing portions described above, the image processing section 107 may be provided with any processing portions required for the image processing.

[Speaker-Position Computation Section]

Figure 8:
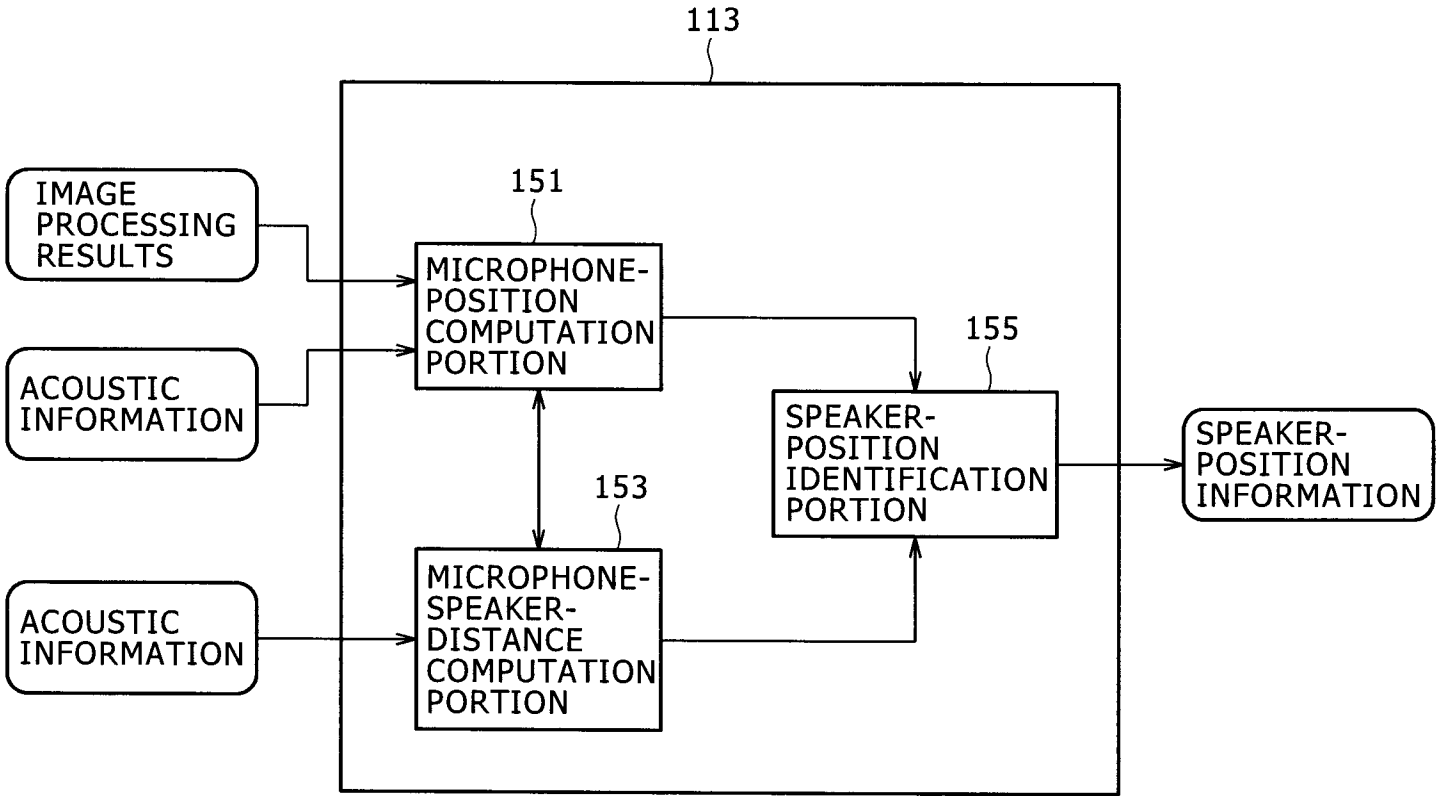
FIG. 8 is a block diagram showing a typical configuration of a speaker-position computation section employed in the acoustic control apparatus according to the embodiment.

Next, by referring to FIG. 8, the configuration of the speaker-position computation section 113 employed in the acoustic control apparatus 10 according to the embodiment is explained. FIG. 8 is a block diagram showing a typical configuration of the speaker-position computation section 113 employed in the acoustic control apparatus 10 according to the embodiment.

As shown in FIG. 8, the speaker-position computation section 113 according to the embodiment typically employs a microphone-position computation portion 151, a microphone-speaker-distance computation portion 153 and a speaker-position identification portion 155.

The microphone-position computation portion 151 typically has a CPU, a ROM and a RAM. The microphone-position computation portion 151 computes the position of the microphone placed in the speaker layout space on the basis of results of the image processing carried out by the image processing section 107 and the acoustic information acquired by the acoustic-information acquisition section 111. In the following description, the position of the microphone is also referred to simply as the microphone position.

For example, the microphone-position computation portion 151 makes use of the result of the face detection carried out by the image processing section 107 in order to compute the position of the microphone on the basis of the result of the face detection on the assumption that the microphone is placed at a location close to the face of the user when the microphone is installed at the time the surround-sound calibration is executed. In addition, the microphone-position computation portion 151 may make use of the result of the object detection carried out by the image processing section 107 in order to compute the position of the microphone. Typical examples of the result of the object detection are the result of microphone detection and the result of detection of a visual marker such as a cyber code. On top of that, the microphone-position computation portion 151 may make use of the acoustic information itself in order to compute the position of the microphone. The acoustic information is the result of sound collection carried out by making use of the microphone to collect sounds each output by one of the speakers 5.

The following description concretely explains a microphone-position computation method by taking a method for computing the position of the user as an example on the assumption that the position of the user almost coincides with the position of the microphone. In the following description, the position of the user is also referred to simply as the user position. In this case, the position of the user is computed by making use of a result of user-face detection based on a taken image generated by a camera mounted on the image display apparatus 3.

For example, the microphone-position computation portion 151 computes the user position relative to the optical axis of the camera. This relative position of the user is represented by directions $\varphi 1$ and $\theta 1$ as well as a distance d1. In this case, the microphone-position computation portion 151 computes the relative position of the user by making use of a variety of results of the image processing carried out by the image processing section 107 and optical information of the camera mounted typically on the image display apparatus 3. The optical information includes information on the field angle of the camera and information on resolution of the camera.

In this case, the results of the image processing carried out by the image processing section 107 include a taken image and information on the user face detected in the taken image. The information on the user face includes face detection positions [a1, b1] and face sizes [w1, h1].

The microphone-position computation portion 151 computes the directions [$\varphi 1$, $\theta 1$] of the relative position of the user from the face detection positions [a1, b1] normalized by making use of the sizes [xmax, ymax] of the taken image and from the field angles [$\varphi 0$, $\theta 0$] of the camera in accordance with Eqs. (101) and (102) given as follows:

$$\text{Horizontal direction: } \varphi 1 = \varphi 0 \times a1 \tag{101}$$

$$\text{Vertical direction: } \theta 1 = \theta 0 \times b1 \tag{102}$$

In addition, the microphone-position computation portion 151 computes the distance d1 of the relative position of the user on the basis of reference face sizes [w0, h0] at a reference distance d0 in accordance with Eq. (103) given as follows:

$$\text{Distance } d1 = d0 \times (w0/w1) \tag{103}$$

Later on, the microphone-position computation portion 151 computes the user three-dimensional position relative to the physical center of the image display apparatus 3 and the front-face direction axis of the image display apparatus 3 on the basis of the result of computation of the user position relative to the optical axis of the camera and camera installation information. The camera installation information includes the installation position of the camera and the installation angle of the camera.

For example, let the coordinates of the physical center of the image display apparatus 3 be [0, 0, 0], the installation position of the camera be [$\Delta x$, $\Delta y$, $\Delta z$], angular differences of the installation angle of the camera be [$\Delta\varphi$, $\Delta\theta$] and the display-screen front-face direction be [0, 0, z].

In this case, the microphone-position computation portion 151 computes the user position [x1, y1, z1] relative to the physical center [0, 0, 0] of the image display apparatus 3 in the coordinate system in accordance with Eqs. (104) to (106) given as follows:

$$x1=d1\times\cos(\theta1-\Delta\theta)\times\tan(\varphi1-\Delta\varphi)-\Delta x \quad (104)$$

$$y1=d1\times\tan(\theta1-\Delta\theta)-\Delta y \quad (105)$$

$$z1=d1\times\cos(\theta1-\Delta\theta)\times\cos(\varphi1-\Delta\varphi)-\Delta z \quad (106)$$

By adoption of the method described above, the microphone-position computation portion 151 is capable of computing the user position almost coinciding with the microphone position from the result of detection of the user face in the taken image. It is to be noted that the method described above is no more than a typical method. That is to say, the microphone-position computation portion 151 is capable of computing the position of the microphone by adoption of a method other than the method described above. For example, the face detection position and the reference-face size which are used in the example described above are replaced with the microphone detection position and the reference-microphone size respectively in order to compute the position of the microphone by making use of a result of detecting the microphone from the taken image.

The microphone-position computation portion 151 supplies information on the computed position of the microphone to the speaker-position identification portion 155 to be described later.

The microphone-speaker-distance computation portion 153 typically has a CPU, a DSP, a ROM and a RAM. The microphone-speaker-distance computation portion 153 computes the distance between the microphone and each of the speakers 5 on the basis of a sound-collection result acquired by the acoustic-information acquisition section 111 as a result of collecting position-computation signals each output individually by one of the speakers 5.

To put it concretely, the microphone-speaker-distance computation portion 153 makes use of a result of collecting position-computation signals each output individually by one of the speakers 5 in order to compute the distance between the microphone and each of the speakers 5 in accordance with a method disclosed in Japanese Patent Laid-open No. 2009-10992. In this case, the result of collecting position-computation signals each output individually by one of the speakers 5 is the magnitude [expressed in terms of dB] of a signal resulting from the collection of the position-computation signals.

The microphone-speaker-distance computation portion 153 supplies information on the distances each computed as a distance between the microphone and one of the speakers 5 to the speaker-position identification portion 155 described as follows.

The speaker-position identification portion 155 typically has a CPU, a ROM and a RAM. The speaker-position identification portion 155 identifies the position of each of the speakers 5 on the basis of the microphone position computed by the microphone-position computation portion 151 as the position of the microphone located in the speaker layout space and the distances each computed by the microphone-speaker-distance computation portion 153 as a distance between the microphone and one of the speakers 5 provided in the speaker layout space.

As described above, the microphone-position computation portion 151 computes the position of the microphone located in the speaker layout space. The microphone-speaker-distance computation portion 153 computes a distance between the microphone placed at the center of the speakers 5 and each of the speakers 5 laid out in the speaker layout space. Thus, any specific one of the speakers 5 is located at a position on the surface of a sphere which has its center coinciding with the position of the microphone and its radius equal to the distance between the microphone and the specific speaker 5. Accordingly, if the speaker-position identification portion 155 is capable of obtaining the position of the microphone and the distance between the microphone and the specific speaker 5 for up to three locations in the speaker layout space by making use of a monaural microphone, the speaker-position identification portion 155 will be capable of identifying the position of the specific speaker 5. As a result, the speaker-position identification portion 155 is capable of computing the coordinates of the position of each of the speakers 5 laid out in the speaker layout space. For example, the coordinates are coordinates in a coordinate system having its origin coinciding with the physical center of the image display apparatus 3.

After identifying the position of each of the speakers 5 laid out in the speaker layout space, the speaker-position identification portion 155 generates speaker-position information, which is information on the positions of all the speakers 5 laid out in the speaker layout space, and supplies the speaker-position information to the general control section 101.

The speaker-position computation section 113 carries out the processing described above in order to compute the position of each of the speakers 5 laid out in the speaker layout space. It is to be noted that a concrete example of the method for computing the position of each of the speakers 5 laid out in the speaker layout space will be additionally explained later.

[Configuration of Acoustic Control Section]

Figure 9:
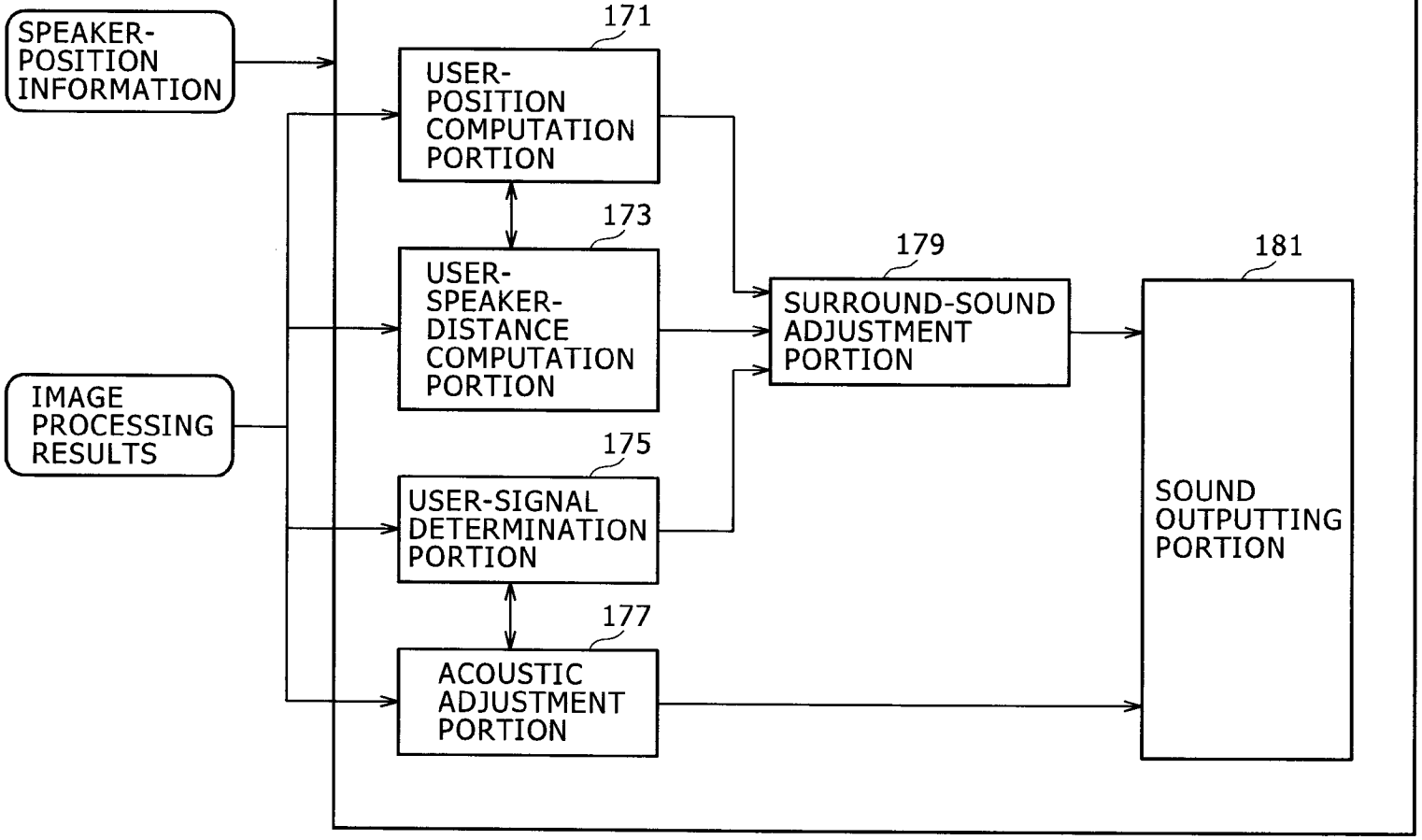
FIG. 9 is a block diagram showing a typical configuration of an acoustic control section employed in the acoustic control apparatus according to the embodiment.

Next, by referring to FIG. 9, the configuration of the acoustic control section 115 employed in the acoustic control apparatus 10 according to the embodiment is explained. FIG. 9 is a block diagram showing a typical configuration of the acoustic control section 115 employed in the acoustic control apparatus 10 according to the embodiment.

As shown in FIG. 9, the acoustic control section 115 according to the embodiment typically employs a user-position computation portion 171, a user-speaker-distance computation portion 173, a user-signal determination portion 175, an acoustic adjustment portion 177, a surround-sound adjustment portion 179 and a sound outputting portion 181.

The user-position computation portion 171 typically has a CPU, a GPU, a ROM and a RAM. The user-position computation portion 171 computes the position of the user on the basis of a result of image processing carried out on a taken image of the user present in the speaker layout space. That is to say, receiving a result of detection of the face of the user present in the speaker layout space from the image processing section 107, the user-position computation portion 171 computes the position of the user by adoption of the same method as that adopted by the microphone-position computation portion 151. The position of the user is a position at which the user is viewing and listening to a content. Thus, the user-position computation portion 171 is capable of computing the coordinates of the position of the user present in the speaker layout space. For example, the coordinates are coordinates in a coordinate system having its origin coinciding with the physical center of the image display apparatus 3.

In this case, if a plurality of users are present in the speaker layout space, the user-position computation portion 171 computes the viewing/listening position of each of the users. In addition, the user-position computation portion 171 may also compute the center of gravity of a group having the users.

The user-position computation portion 171 supplies the computation result obtained in this way to the user-speaker-distance computation portion 173 and the surround-sound adjustment portion 179. In the following description, the computation result is also referred to as viewing/listening-position information which is information on the viewing/listening position.

The user-speaker-distance computation portion 173 typically has a CPU, a ROM and a RAM. The user-speaker-distance computation portion 173 computes the distance between the viewing/listening position and each of the speakers 5 on the basis of the viewing/listening-position information received from the user-position computation portion 171 and the speaker-position information generated by the speaker-position computation section 113. Both the viewing/listening-position information and the speaker-position information include information on coordinate values. For example, the coordinate values are the values of coordinates in a coordinate system having its origin coinciding with the physical center of the image display apparatus 3. For this reason, the user-speaker-distance computation portion 173 geometrically computes a distance between the 2 sets of coordinate values in order to find the distance between the viewing/listening position and each of the speakers 5 laid out in the speaker layout space.

The user-speaker-distance computation portion 173 supplies the user-speaker distance information to the surround-sound adjustment portion 179. The user-speaker distance information is information on the computed distance between the viewing/listening position and each of the speakers 5 laid out in the speaker layout space.

The user-signal determination portion 175 typically has a CPU, a ROM and a RAM. The user-signal determination portion 175 makes use of information including a gesture recognition result received from the image processing section 107 in order to determine whether or not a variety of gestures made by the user include a gesture having a special meaning.

For example, if a configuration for carrying out surround-sound calibration by taking the position of the user waving its hand as a center has been set in advance, the user-signal determination portion 175 determines whether or not a variety of detected gestures made by the user include a hand waving gesture having a special meaning. By detecting a user making a gesture having a special meaning, for example, it is possible to carry out surround-sound calibration by taking the position of the user waving its hand as a center.

In addition, the user-signal determination portion 175 may make use of information including a face recognition result received from the image processing section 107 in order to assign a priority level to each user for a case in which there are a plurality of users. To put it in detail, the user-signal determination portion 175 sets a priority order for the users in accordance with a policy based on the priority levels each assigned to one of the registered users, the distance between the image display apparatus 3 and each of the users, and the content viewing/listening state of each of the users. The content viewing/listening state of a user is a state in which the user is most paying attention to a content and viewing as well as listening to the content.

In addition, if the acoustic control apparatus 10 according to the embodiment has a voice/sound recognition function for example, the user-signal determination portion 175 may determine whether or not there is a user speaking a word. If a user speaking a word is detected for example, the surround-sound calibration can be carried out by typically taking the user as the center.

The user-signal determination portion 175 supplies the determination results to the acoustic adjustment portion 177 and the surround-sound adjustment portion 179.

The acoustic adjustment portion 177 typically has a CPU, a DSP, a ROM and a RAM. The acoustic adjustment portion 177 adjusts, among others, the quality of an output sound on the basis of the image processing results received from the image processing section 107, the determination results received from the user-signal determination portion 175 and other information. The image processing results include metadata of the user, the metadata typically including the age and the gender.

For example, if the user is an aged person above an age determined in advance, the acoustic adjustment portion 177 is capable of adjusting the output sound by putting the sound in the high-tone range and raising the setting value of the sound. If the user is a child under an age determined in advance, on the other hand, the acoustic adjustment portion 177 is capable of adjusting the output sound by reducing the dynamic range of the sound. By carrying out such adjustments, it is possible to provide the user with surround sounds proper for the physical characteristic of the user.

In addition, by making use of the result of the face recognition processing, the acoustic adjustment portion 177 is capable of carrying out surround sound equalizing adjusted to individual favorites of the user.

Also, if there are a plurality of users, the acoustic adjustment portion 177 is capable of carrying out adjustment of the quality of the output sound in accordance with a variety of conditions set in advance. As an example, the acoustic adjustment portion 177 is capable of adjusting the quality of the output sound by considering the priority order established for the users so as to give the highest priority to typically an aged person or a child. As another example, the acoustic adjustment portion 177 is capable of adjusting the quality of the output sound by carrying out equalizing which satisfies conditions set for all the users. As a further example, the acoustic adjustment portion 177 is capable of adjusting the quality of the output sound by giving the highest priority to a user making a specific gesture and sound.

When the surround-sound adjustment described above is completed, the acoustic adjustment portion 177 supplies the determined sound output setting to the sound outputting portion 181. The sound output setting is typically related to the quality of the output sound.

The surround-sound adjustment portion 179 typically has a CPU, a DSP, a ROM and a RAM. The surround-sound adjustment portion 179 carries out surround-sound adjustment also referred to as surround-sound calibration in accordance with the viewing/listening position computed by the user-position computation portion 171, the user-speaker distances computed by the user-speaker-distance computation portion 173 and the determination results produced by the user-signal determination portion 175.

Specifically, the surround-sound adjustment portion 179 carries out the surround-sound calibration in order to generate a sweet spot with its center coinciding with the position of the user. It is desirable to generate the sweet spot which encloses the user and has a circular or elliptical shape as well as a minimum size.

In addition, if there are a plurality of users, the surround-sound adjustment portion 179 may carry out the surround-sound calibration in order to generate a sweet spot which typically has its center coinciding with the center of gravity of a group having the users and further exhibits spreading. Also, if the user-signal determination portion 175 has set a priority level for each of the users, the surround-sound adjustment portion 179 may carry out the surround-sound calibration in accordance with the priority levels in order to generate a sweet spot with its center coinciding with the user having the highest priority level. Furthermore, the surround-sound adjustment portion 179 may carry out the surround-sound calibration by making use of the result of the face recognition in order to generate a sweet spot with its center coinciding with the position of a specific user indicated by the face recognition result.

After confirming the setting for the surround-sound adjustment, the surround-sound adjustment portion 179 supplies the information on the setting to the sound outputting portion 181.

It is to be noted that the surround-sound calibration method adopted by the surround-sound adjustment portion 179 can be any known method for surround-sound calibration.

The sound outputting portion 181 typically has a CPU, a DSP, a ROM and a RAM. The sound outputting portion 181 outputs surround sounds of a content from the speakers 5 laid out in the speaker layout space on the basis of the acoustic output setting output by the acoustic adjustment portion 177 and the surround-sound adjustment portion 179.

The above description explains details of the configuration of the acoustic control section 115 according to the embodiment by referring to FIG. 9.

The above descriptions explain typical functions of the acoustic control apparatus 10 according to the embodiment. Each configuration element can be configured by making use of a general-purpose member or a general-purpose circuit or by making use of hardware designed specially for the function of the configuration element. As an alternative, all the functions of every configuration element can be carried out by a CPU or the like. Thus, in accordance with a technological level which is improved from time to time as a level for implementing the embodiment, the configuration of the hardware for implementing every configuration element can be changed properly.

It is to be noted that, it is possible to create a computer program for implementing each function of the acoustic control apparatus according to the embodiment like the one described above and make use of a personal computer or the like to execute the program. In addition, it is also possible to provide the user with a recording medium used for storing the computer program in such a way that the personal computer or the like is capable of reading out the program from the recording medium. Typical examples of the recording medium are a magnetic disk, an optical disk, a magneto-optical disk and a flash memory. In addition, instead of using such a recording medium, the computer program can be distributed to users through typically a network.

(2-3): Typical Concrete Method for Computing Speaker Positions

A typical concrete method for computing the position of each of the speakers 5 is explained briefly by referring to FIGS. 10 to 13. FIGS. 10 to 13 are explanatory diagrams referred to in the following description of the typical concrete method for computing the position of each of the speakers 5 in accordance with the embodiment.

Figure 10:
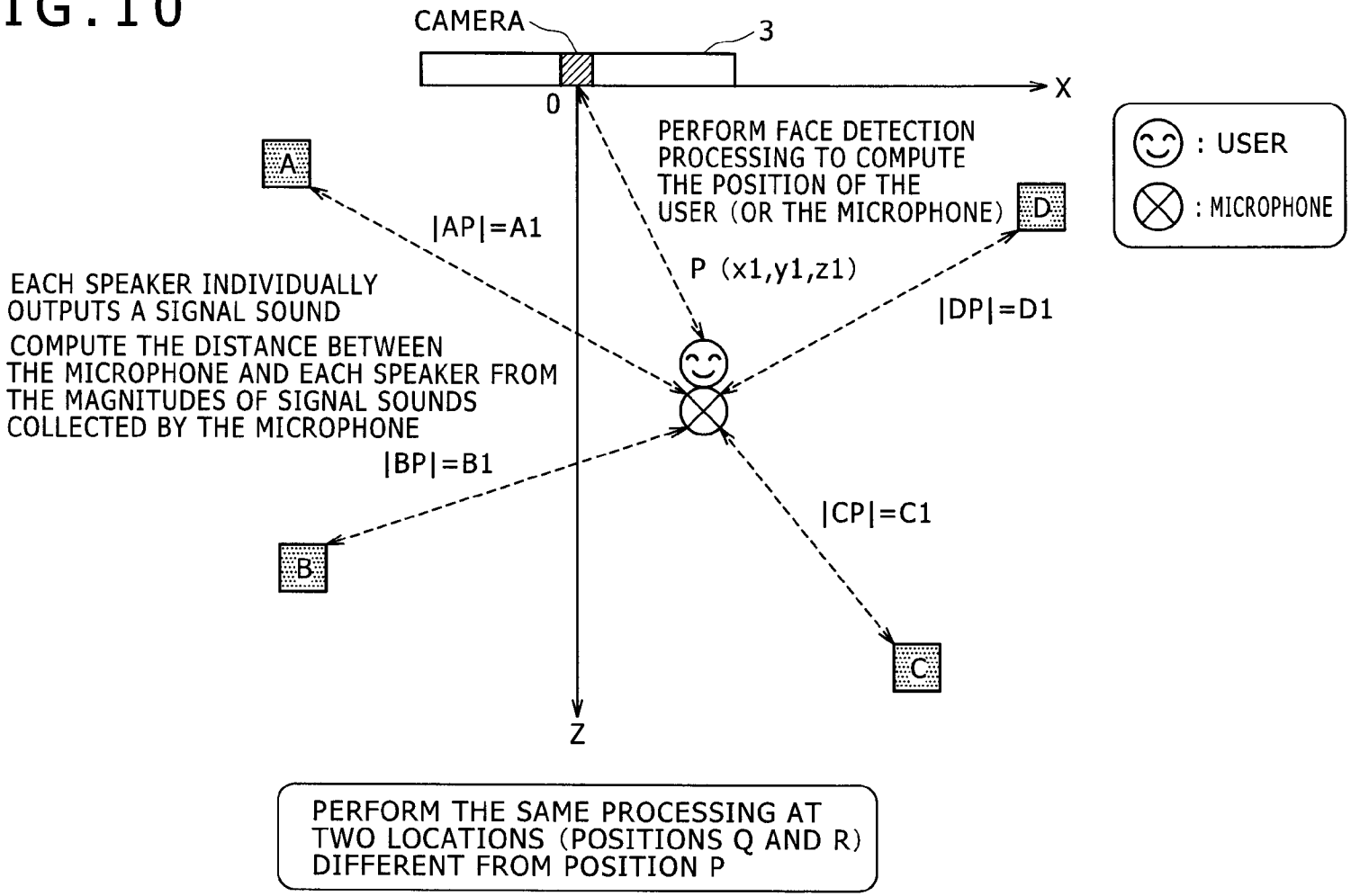
FIG. 10 is an explanatory diagram to be referred to in description of a method for computing the position of each speaker in accordance with the embodiment.

The following description assumes a coordinate system having its origin coinciding with the physical center of the image display apparatus 3 as shown in FIG. 10. The optical axis of the camera coincides with the Z axis of the coordinate system. In addition, in the speaker layout space on the coordinate system, four speakers are provided. In the figure, the four speakers are shown as speakers A to D respectively. In addition, in an example described below, the microphone in use is assumed to be a monaural microphone.

In this case, in order to compute the position of every speaker, the user holds the monaural microphone and stays statically at a position P in the speaker layout space. Typically, in order to reduce a position identification error, the user holds the monaural microphone at a location close to the face. In this state, the camera provided on the image display apparatus 3 takes an image of the user holding the monaural microphone, generating a taken image of the monaural microphone and an object placed at a location close to the position of the microphone. In this case, the object placed at a location close to the position of the monaural microphone is the face of the user. Then, the camera supplies the taken image to the acoustic control apparatus 10 not shown in the figure by way of the image display apparatus 3 connected to the acoustic control apparatus 10 by typically an HDMI (High-Definition Multimedia Interface) cable.

Receiving the taken image including the monaural microphone and the face of the user from the image display apparatus 3, the acoustic control apparatus 10 computes the position P of the face of the user by adoption of the same method as that described earlier. As is obvious from the above description, the position P of the face of the user is the installation position P of the monaural microphone. In this example, the position P of the face of the user or the installation position P of the monaural microphone is represented by coordinates (x1, y1, z1) in the figure.

Then, the acoustic control apparatus 10 outputs a position computation signal such as a beep sound individually from each of the speakers A to D to the monaural microphone placed at the position P to serve as a microphone for collecting the position computation signals coming from each of the speakers A to D. The acoustic control apparatus 10 acquires the result of the sound collection carried out by the monaural microphone as acoustic information and computes the distance between the microphone and each of the speakers A to D from the magnitudes of signal sounds included in the result of the sound collection.

In the example shown in FIG. 10, the distance |AP| between the monaural microphone and the speaker A is A1, the distance |BP| between the monaural microphone and the speaker B is B1, the distance |CP| between the monaural microphone and the speaker C is C1, the distance |DF| between the monaural microphone and the speaker D is D1.

While holding the monaural microphone, the user moves in the speaker layout space from the position P to two positions Q and R. In this case, the acoustic control apparatus 10 carries out the same processing as that described above for each of the positions Q and R.

As a result, the acoustic control apparatus 10 is capable of computing data shown in FIG. 11A to represent coordinates of the positions P, Q and R of the monaural microphone as well as data shown in FIG. 11B to represent the distances between the positions P, Q and R and the speakers A to D.

Figure 12:
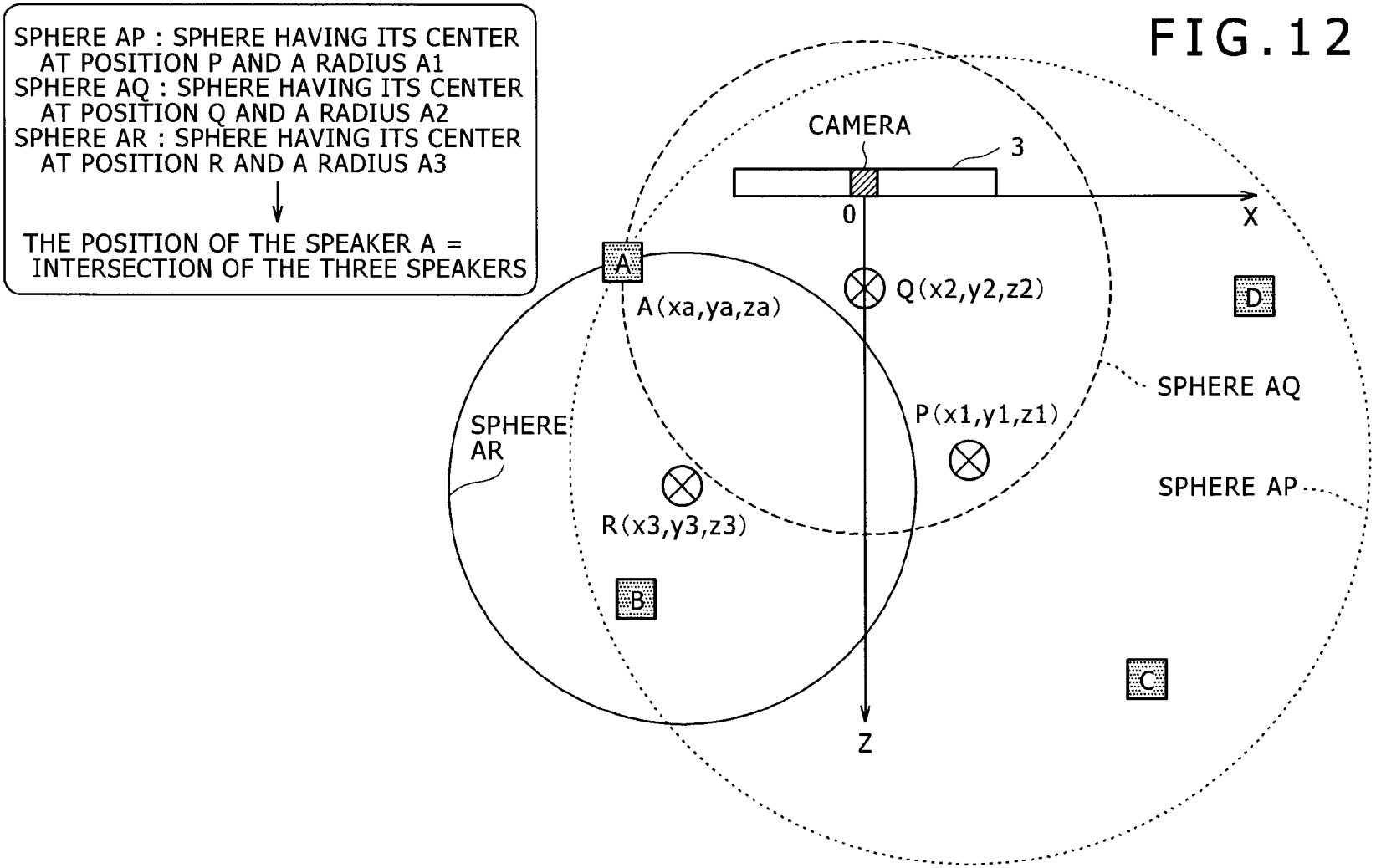
FIG. 12 is an explanatory diagram to be referred to in description of a method for computing the position of a speaker in accordance with the embodiment.

FIG. 12 is an explanatory diagram referred to in the following description of a method adopted by the acoustic control apparatus 10 to compute the position of the speaker A in accordance with the embodiment. As shown in FIGS. 11A and 11B, the acoustic control apparatus 10 determines that the speaker A has been placed at a location which is separated away from the position P by the distance A1, separated away from the position Q by the distance A2, and separated away from the position R by the distance A3.

Thus, as shown in FIG. 12, the acoustic control apparatus 10 pays attention to the spherical surfaces of 3 different spheres AP, AQ and AR having radiuses A1, A2 and A3 respectively and centers coinciding with the positions P, Q and R respectively. Then, the acoustic control apparatus 10 computes an intersection of the spherical surfaces of the three different spheres AP, AQ and AR. In this way, the acoustic control apparatus 10 is capable of computing the position (xa, ya, za) of the speaker A.

The acoustic control apparatus 10 carries out the processing described above also for the speakers B to D as well. Thus, the acoustic control apparatus 10 is capable of computing the coordinates of the positions of the speakers A to D in the speaker layout space.

Figure 13:
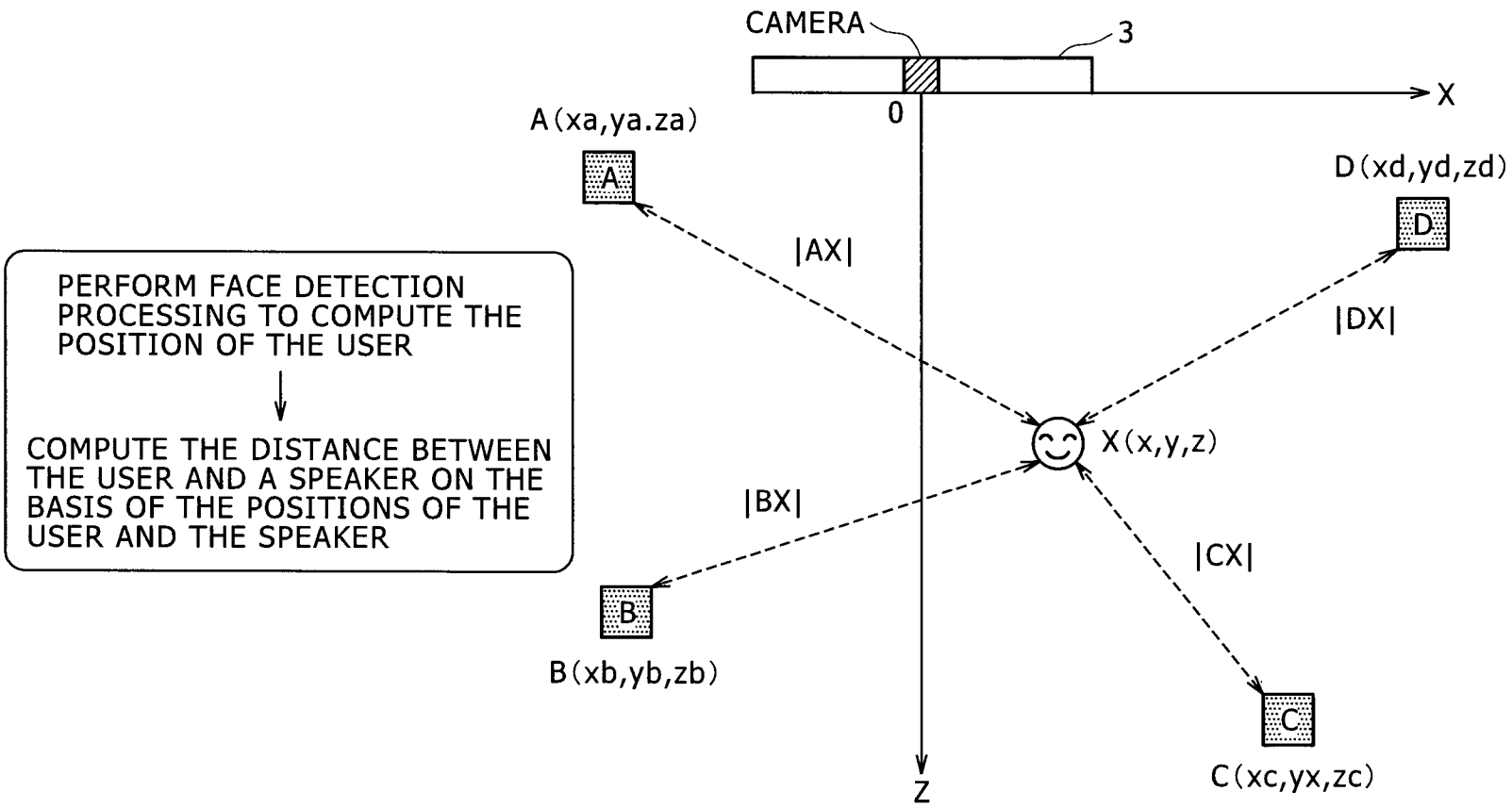
FIG. 13 is an explanatory diagram to be referred to in description of a method for computing the position of a speaker in accordance with the embodiment.

By identifying the coordinates of the positions A (xa, ya, za), B (xb, yb, zb), C (xc, yc, zc) and D (xd, yd, zd) of the speakers A to D respectively in the speaker layout space as described above, the acoustic control apparatus 10 is capable of easily computing the distances |AX|, |BX|, |CX| and |DX| from a position X (x, y, z) shown in FIG. 13 as the current position of the user present in the speaker layout space at a certain point of time to the positions A (xa, ya, za), B (xb, yb, zb), C (xc, yc, zc) and D (xd, yd, zd) of the speakers A to D respectively once the position X (x, y, z) of the user has been identified.

The acoustic control apparatus 10 typically carries out polling on the image display apparatus 3 and the camera for the position of the user so that the image display apparatus 3 and the camera output a new taken image used for computing the new position of the user if the user position relative to the image display apparatus 3 and the camera changes. By adopting this method or the like, the acoustic control apparatus 10 is capable of monitoring dynamical changes in user position. Thus, the acoustic control apparatus 10 is capable of monitoring dynamical changes of the viewing/listening position of the user from time to time. As a result, the sound can be made dynamically adaptive to the viewing/listening position of the user.

In the example described above, the position of every speaker is computed once by making use of three different installation locations of the monaural microphone whereas the distance between every speaker and the microphone or the user is updated each time the position of the microphone or the position of the user is changed. It is to be noted, however, that if the direction of the heights of the speakers and the user can be assumed to be ignorable, the position of every speaker can be computed by making use of two different installation locations of the microphone. In the figures, the direction of the heights of the speakers and the user is the direction of the Y axis.

(2-4): Typical Modified Methods for Computing Microphone Position

Figure 14:
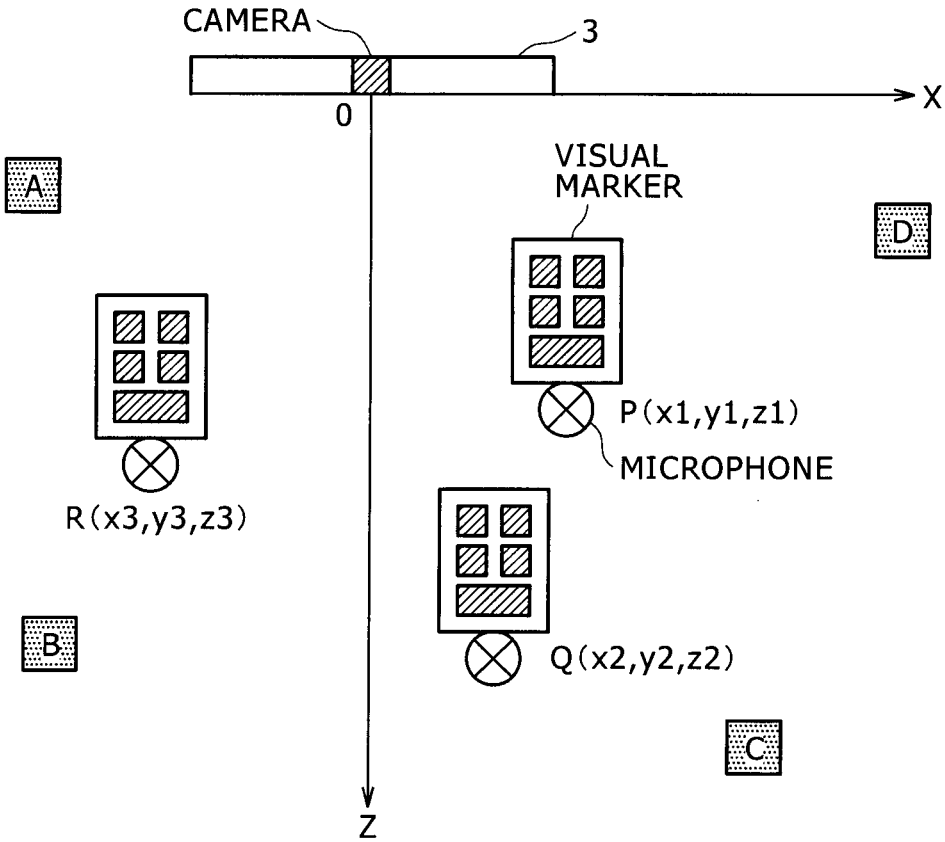
FIG. 14 is an explanatory diagram to be referred to in description of a method for computing the position of a microphone in accordance with the embodiment.
Figure 15:
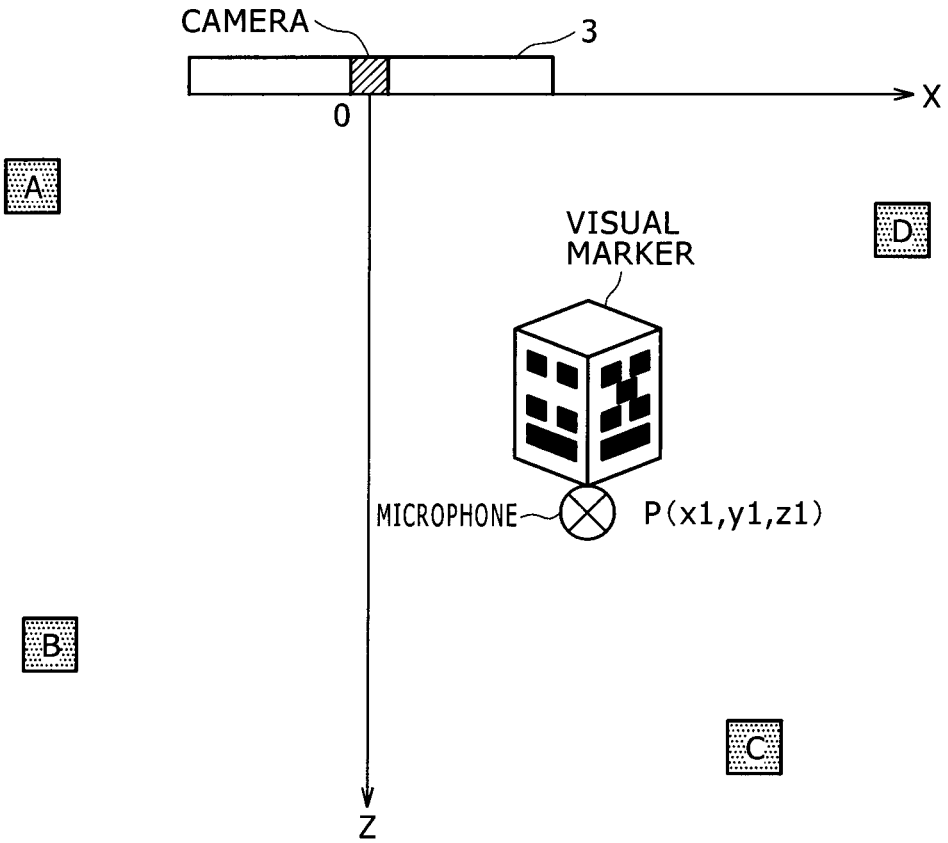
FIG. 15 is an explanatory diagram to be referred to in description of a method for computing the position of a microphone in accordance with the embodiment.
Figure 16:
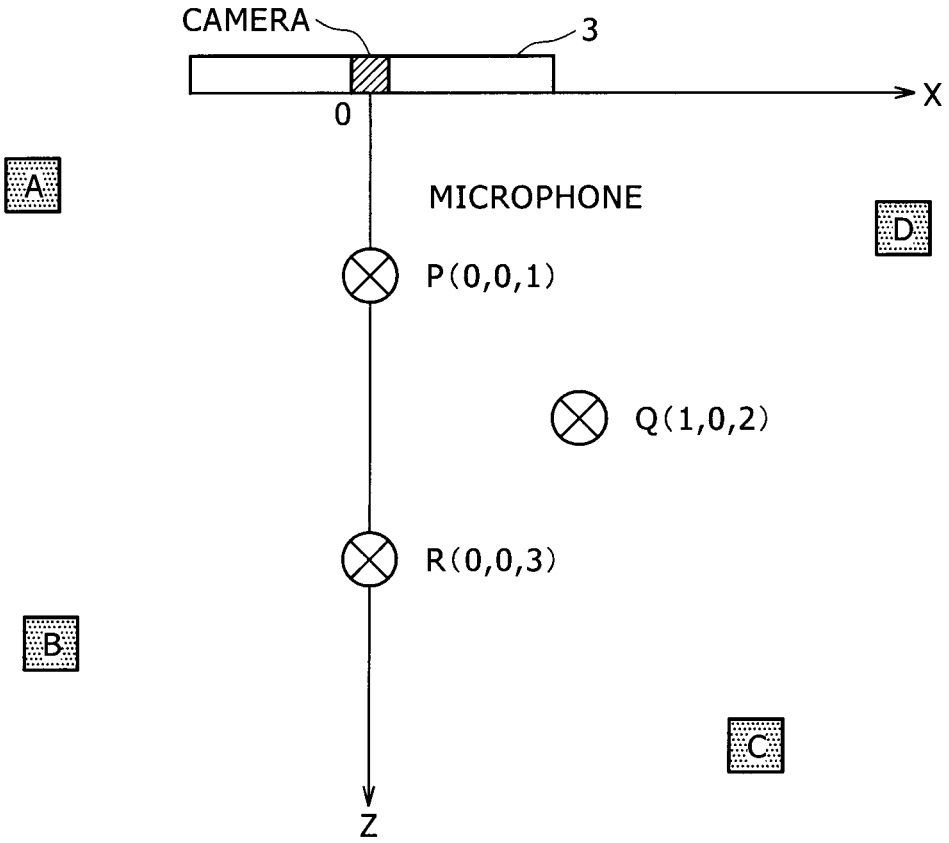
FIG. 16 is an explanatory diagram to be referred to in description of a method for computing the position of a microphone in accordance with the embodiment.

By referring to FIGS. 14 to 16, typical modified methods for computing the position of the microphone are explained briefly as follows. FIGS. 14 to 16 are explanatory diagrams referred to in the following description of the typical modified methods each adopted for computing the position of the monaural microphone in accordance with the embodiment.

In the concrete example explained earlier by referring to FIGS. 10 to 13, the position of the monaural microphone is computed by paying attention to the face of the user close to the monaural microphone. However, the position of the monaural microphone can also be computed by adoption of a method like one described as follows.

In a typical arrangement shown in FIG. 14 for example, a visual marker such as a cyber code is attached to the monaural microphone in order to implement a method for computing the position of the monaural microphone. The visual marker such as a cyber code is attached to the monaural microphone and the position of the microphone is changed among three locations different from each other so that the acoustic control apparatus 10 is capable of computing the position of the monaural microphone marked with the visual marker by carrying out image processing on three taken images of the microphone placed at the three different locations respectively.

In addition, in the typical arrangement shown in FIG. 14, a two-dimensional visual marker is attached to the monaural microphone. As shown in FIG. 15, however, a visual marker usable for computing a three-dimensional posture is attached to the monaural microphone in order to allow the position of the microphone to be found. In the case of the typical example shown in FIG. 15, each of the speakers A to D outputs a position computation signal with the surfaces of the visual marker oriented in directions toward the speakers A to D.

Thus, by carrying out the image processing in order to detect the visual marker, it is not only possible to detect the position of the monaural microphone but also possible to compute the positions of the speakers on the basis of the position and the orientation of the marker and the distances from the marker to the speakers. As a result, the surround-sound calibration can be carried out without the need to move the monaural microphone.

In addition, in place of the three-dimensional visual marker like the one shown in FIG. 15, the face of the user can also be used to infer the position and the posture of the microphone. Thus, it is possible to adopt a method in accordance with which the face of the user is oriented in the direction toward a speaker.

Also, in place of the methods explained above by referring to FIGS. 14 and 15, it is needless to say that the position of the monaural microphone can be identified by installing the microphone at a specified location in the speaker layout space as shown in FIG. 16.

(2-5): Microphone Types

In the typical methods explained above, a monaural microphone is used. Even though the monaural microphone has a merit of being inexpensive, it has a demerit of the need to place the microphone at three different locations.

Figure 17:
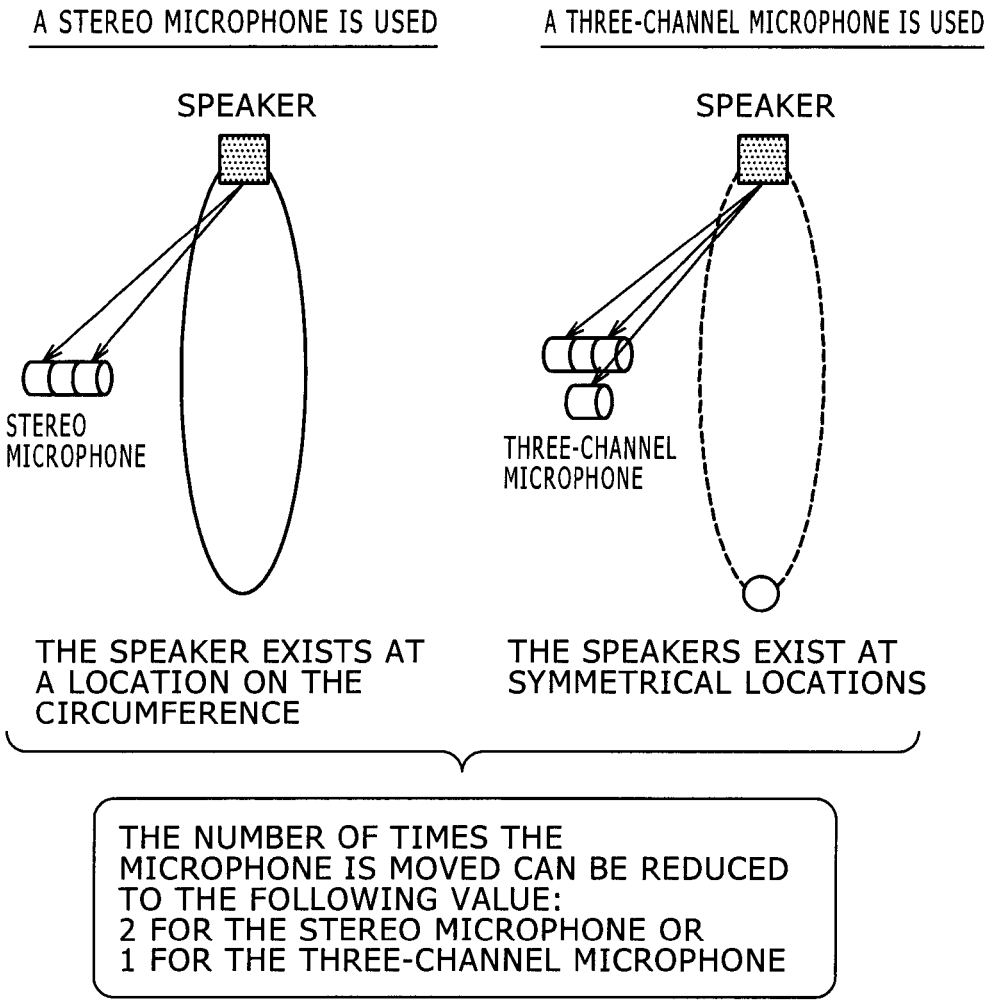
FIG. 17 is an explanatory diagram to be referred to in description of an acoustic control method according to the embodiment.

On the other hand, since a stereo microphone collects sounds output by speakers as stereo sounds, it is possible to compute not only the distance between the microphone and a speaker, but also the direction of a straight line connecting the microphone to the speaker. As a result, by making use of a stereo microphone, the position of a speaker can be found by searching only the circumference of a circle as shown in FIG. 17. Thus, by making use of a stereo microphone in the method according to the embodiment, it is possible to reduce the number of times the microphone should be moved to twice.

In addition, a three-channel microphone collects sounds output by speakers as three-channel sounds. Thus, the position of a speaker can be found by searching only mutually symmetrical positions as shown in FIG. 17. As a result, by making use of a three-channel microphone in the method according to the embodiment, it is possible to reduce the number of times the microphone should be moved to one.

(2-6): Flows of Acoustic Control Method

Figure 18:
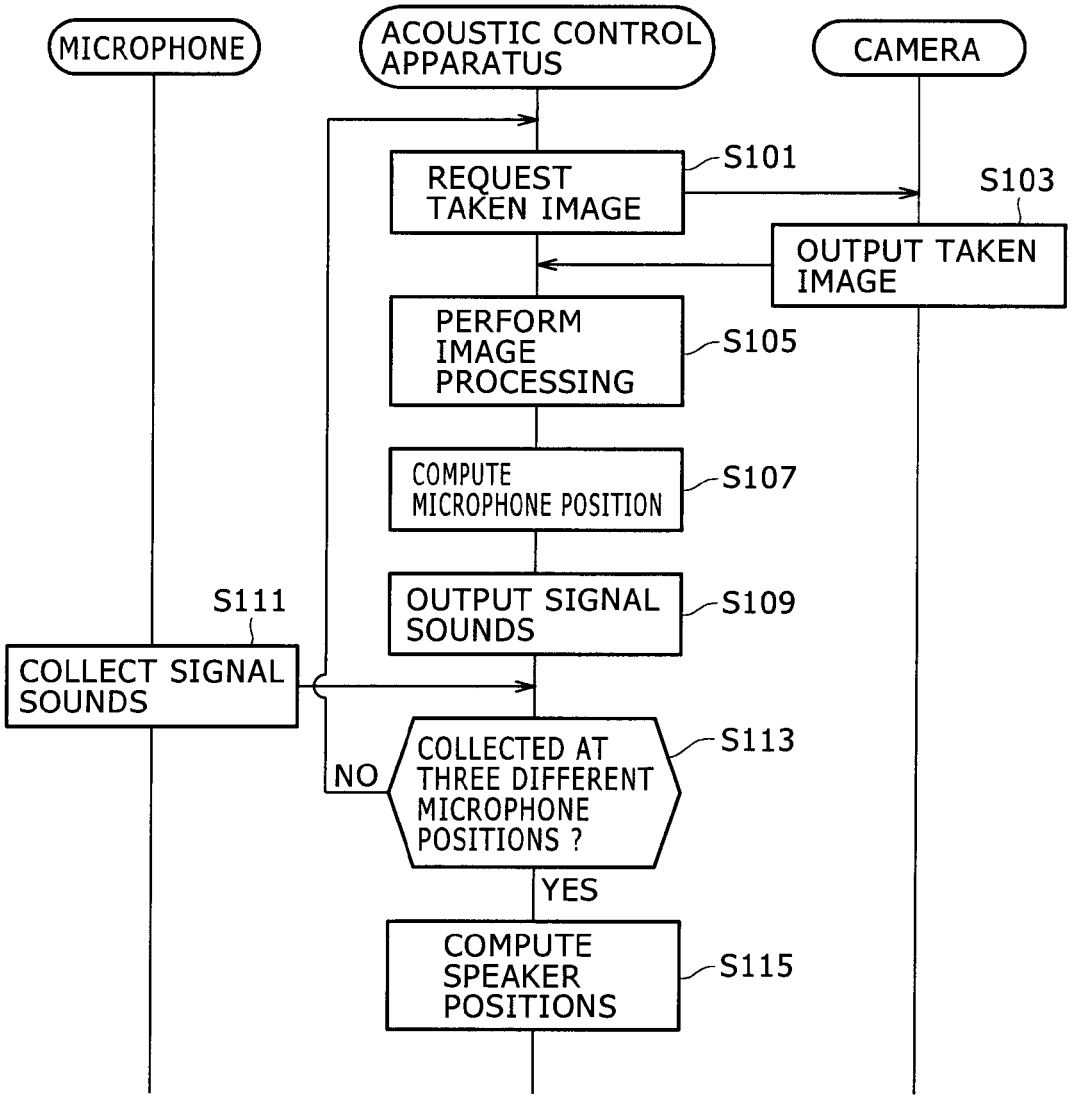
FIG. 18 shows a flowchart representing a typical flow of the acoustic control method according to the embodiment.
Figure 19:
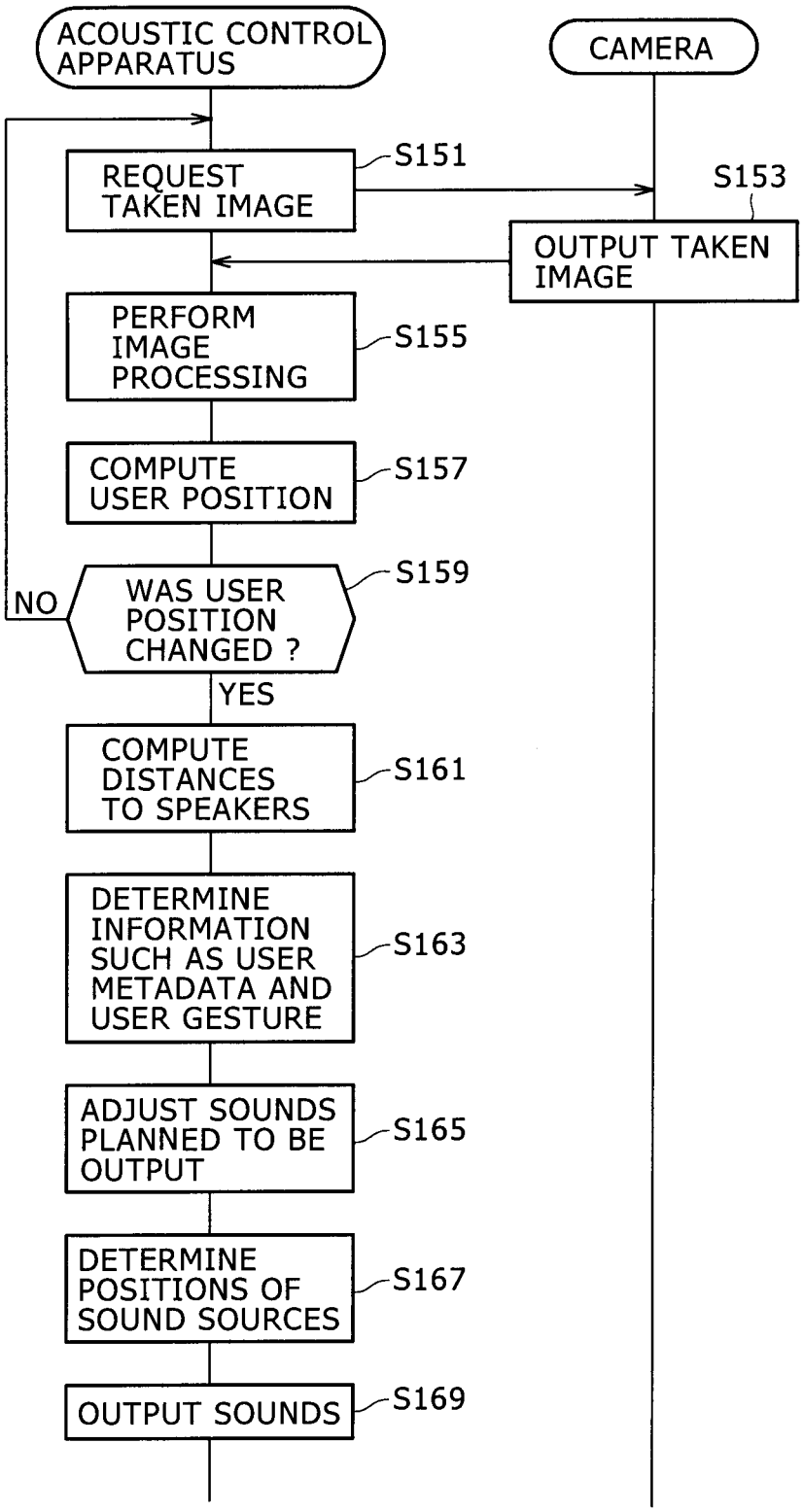
FIG. 19 shows a flowchart representing a typical flow of the acoustic control method according to the embodiment.

Next, typical flows of the acoustic control method according to the embodiment are briefly explained by referring to FIGS. 18 and 19 as follows. FIGS. 18 and 19 each show a flowchart representing one of the typical flows of the acoustic control method according to the embodiment.

First of all, by referring to the flowchart shown in FIG. 18, the following description briefly explains the flow of the method for computing the position of every speaker.

The flowchart begins with a step S101 at which the general control section 101 employed in the acoustic control apparatus 10 requests the camera to output a taken image. At a step S103, at the request made by the general control section 101, the camera outputs a taken image of the microphone and an object placed at a location close to the position of the microphone to the acoustic control apparatus 10.

In the acoustic control apparatus 10, the image acquisition section 105 receives the taken image output by the camera and passes on the image to the general control section 101. Then, the general control section 101 forwards the taken image received from the image acquisition section 105 to the image processing section 107.

In the acoustic control apparatus 10, the image processing section 107 carries out image processing on the taken image received from the general control section 101 at a step S105. The image processing includes face detection processing, object detection processing and gesture recognition processing. The image processing section 107 then outputs the result of the image processing to the general control section 101. Subsequently, the general control section 101 passes on the image-processing result received from the image processing section 107 to the speaker-position computation section 113.

The image-processing result received by the speaker-position computation section 113 from the general control section 101 is the result of the image processing carried out by the image processing section 107 on the taken image including the microphone and the object placed at a location close to the position of the microphone. In the acoustic control apparatus 10, the speaker-position computation section 113 passes on the result of the image processing to the microphone-position computation portion 151. At a step S107, the microphone-position computation portion 151 makes use of the result of the image processing in order to compute the position of the microphone by adoption of the method such as the one explained before.

In the mean time, the general control section 101 requests the position-computation-signal control section 109 to start processing to drive speakers 5. At the request made by the general control section 101, the position-computation-signal control section 109 drives each of the speakers 5 to individually output a signal sound at a step S109. At a step S111, the microphone installed at a certain location collects the signal sound output individually by the speakers 5 and outputs the result of the sound collection to the acoustic control apparatus 10.

In the acoustic control apparatus 10, the acoustic-information acquisition section 111 receives the result of the sound collection from the microphone and passes on the result to the general control section 101. The general control section 101 receives the result of the sound collection from the acoustic-information acquisition section 111 as acoustic information and passes on this information to the speaker-position computation section 113. Then, at a step S113, the general control section 101 determines whether or not the microphone has collected signal sounds from the speakers 5 for three different locations of the microphone. If the general control section 101 determines at the step S113 that the microphone has not collected signal sounds from the speakers 5 for three different locations of the microphone, the acoustic control apparatus 10 continues the processing of the acoustic control method by going back to the step S101.

If the general control section 101 determines at the step S113 that the microphone has collected signal sounds from the speakers 5 for three different locations of the microphone, on the other hand, the acoustic control apparatus 10 continues the processing of the acoustic control method by going on to a step S115 at which the general control section 101 requests the speaker-position computation section 113 to compute the positions of the speakers 5. At the request made by the general control section 101, the microphone-speaker-distance computation portion 153 employed in the speaker-position computation section 113 computes the distance between the position of the microphone and the position of each of the speakers 5 on the basis of the microphone position computed by the microphone-position computation portion 151 and the acoustic information received from the general control section 101. Then, on the basis of the computed distance between the position of the microphone and the position of each of the speakers 5, the speaker-position identification portion 155 identifies the position of each of the speakers 5. In this way, the positions of the speakers 5 laid out in the speaker layout space can be computed at the step S115.

Next, by referring to the flowchart shown in FIG. 19, the following description briefly explains the flow of the surround-sound adjustment method.

The flowchart begins with a step S151 at which the general control section 101 employed in the acoustic control apparatus 10 requests the camera to output a taken image. At a step S153, at the request made by the general control section 101, the camera outputs a taken image of the user present in the speaker layout space to the acoustic control apparatus 10.

In the acoustic control apparatus 10, the image acquisition section 105 receives the taken image of the user from the camera and passes on the image to the general control section 101. Then, the general control section 101 passes on the taken image received from the image acquisition section 105 to the image processing section 107.

In the acoustic control apparatus 10, the image processing section 107 carries out image processing on the taken image received from the general control section 101 at a step S155. The image processing includes face detection processing, object detection processing and gesture recognition processing. The image processing section 107 then outputs the result of the image processing to the general control section 101. Subsequently, the general control section 101 passes on the image-processing result received from the image processing section 107 to the acoustic control section 115.

At a step S157, on the basis of the image-processing result received from the general control section 101, the user-position computation portion 171 employed in the acoustic control section 115 computes the position of the user by adoption of the method such as the one explained before.

Then, at the next step S159, in the acoustic control apparatus 10, the general control section 101 or the acoustic control section 115 determines whether or not the position of the user has changed. If the general control section 101 or the acoustic control section 115 determines at the step S159 that the position of the user has not changed, the acoustic control apparatus 10 continues the processing of the acoustic control method by going back to the step S151. If the general control section 101 or the acoustic control section 115 determines at the step S159 that the position of the user has changed, on the other hand, the acoustic control apparatus 10 determines that dynamic surround-sound calibration is required to be performed and continues the processing of the acoustic control method by going on to a step S161 to be described below.

At the step S161, the user-position computation portion 171 re-computes the new position of the user whereas the user-speaker-distance computation portion 173 employed in the acoustic control section 115 computes the distance between the new position of the user and the position of each of the speakers 5 on the basis of speaker-position information stored in the storage section 119 or the like and the user position computed by the user-position computation portion 171.

Then, at the next step S163, on the basis of the result of the image processing, the user-signal determination portion 175 employed in the acoustic control section 115 recognizes information such as metadata of the user and a gesture made by the user. The metadata of the user includes the age of the user. Subsequently, at the next step S165, on the basis of the metadata of the user, the acoustic adjustment portion 177 employed in the acoustic control section 115 adjusts attributes of a sound planned to be output and supplies sound setting to the sound outputting portion 181 as the result of the adjustment. The attributes of a sound include the quality of the sound.

Then, at the next step S167, on the basis of the processing results produced by the user-position computation portion 171, the user-speaker-distance computation portion 173 and the user-signal determination portion 175, the surround-sound adjustment portion 179 employed in the acoustic control section 115 carries out position determination processing to determine the positions of sound sources. Subsequently, the surround-sound adjustment portion 179 supplies position-determination setting to the sound outputting portion 181 as the result of the determination processing to determine the positions of the sound sources.

Subsequently, at the next step S169, on the basis of the sound setting received from the acoustic adjustment portion 177 and the position-determination setting received from the surround-sound adjustment portion 179, the sound outputting portion 181 of the acoustic control section 115 drives the speakers 5 to output sounds. In this way, the speakers 5 are capable of outputting sounds proper for the new position of the user.

By referring to the flowcharts shown in FIGS. 18 and 19, the above descriptions briefly explain the flows of the acoustic control method according to the embodiment.

Figure 20:
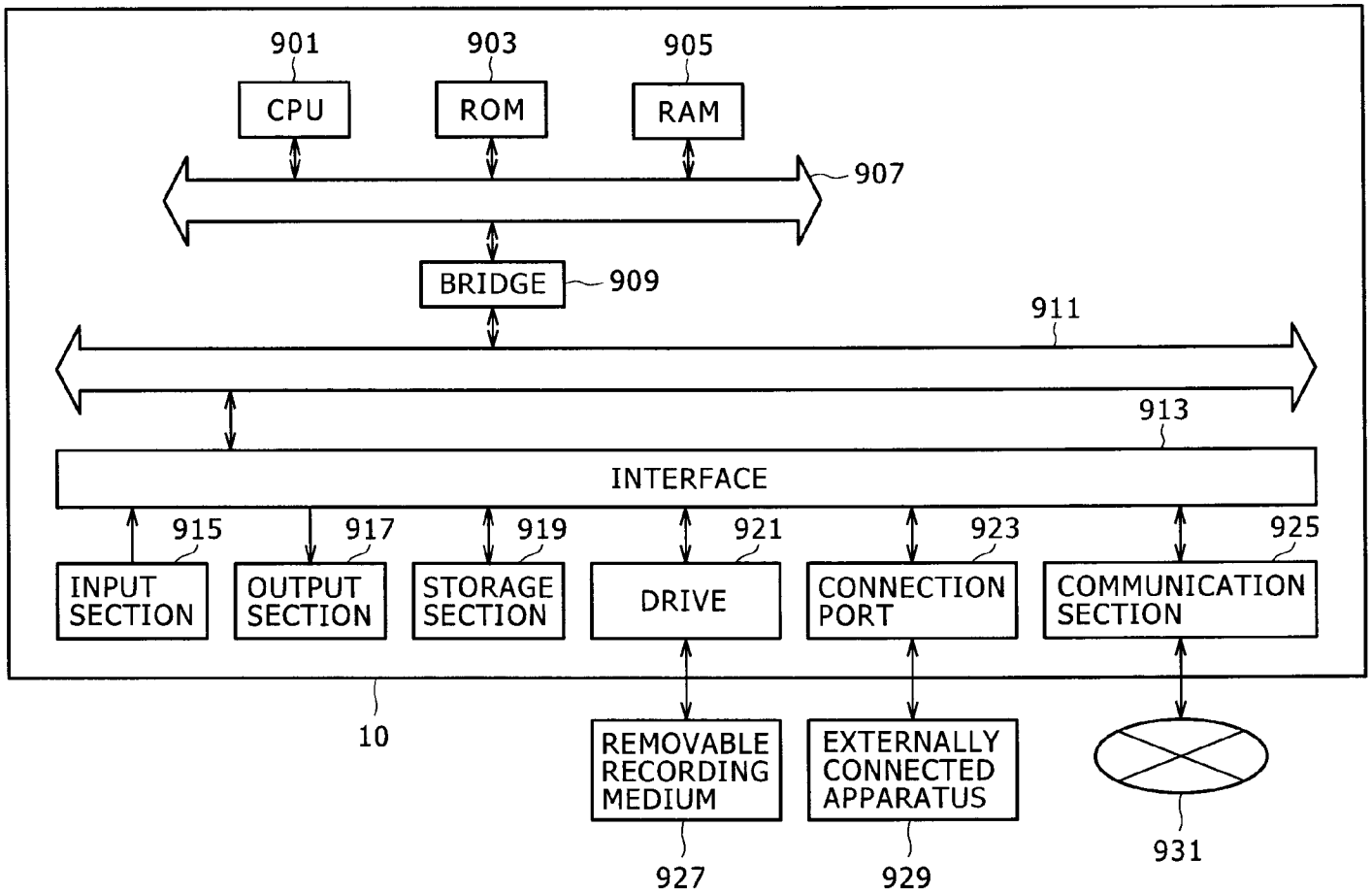
FIG. 20 is a block diagram showing the hardware configuration of an acoustic control apparatus according to an embodiment of the present disclosure.

(3): Hardware Configuration of Acoustic Control Apparatus According to Present Embodiment Next, by referring to FIG. 20, the following description explains details of the hardware configuration of the acoustic control apparatus 10 according to the embodiment of the present disclosure. FIG. 20 is a block diagram showing the hardware configuration of the acoustic control apparatus 10 according to an embodiment of the present disclosure.

As shown in the figure, the acoustic control apparatus 10 employs main components including a CPU 901, a ROM 903 and a RAM 905. In addition, the acoustic control apparatus 10 also has a host bus 907, a bridge 909, an external bus 911, an interface 913, an input section 915, an output section 917, a storage section 919, a drive 921, a connection port 923 and a communication section 925.

The CPU 901 functions as a processing section as well as a control section. The CPU 901 controls all or some operations, which are carried out in the acoustic control apparatus 10, in accordance with a variety of programs stored in the ROM 903, the RAM 905, the storage section 919 or a removable recording medium 927 mounted on the drive 921. The ROM 903 is a memory used for storing the programs to be executed by the CPU 901 and data such as processing parameters. The RAM 905 is a memory used for temporarily storing the programs to be executed by the CPU 901 and parameters changed in the course of the execution of the programs. The CPU 901, the ROM 903 and the RAM 905 are connected to each other by the host bus 907 which is an internal bus such as a CPU bus.

The host bus 907 is connected to the external bus 911 such as a PCI (Peripheral Component Interconnect/Interface) bus by the bridge 909.

The input section 915 is an operation section to be operated by the user. The input section 915 typically includes a mouse, a keyboard, a touch panel, buttons, switches and a lever. The input section 915 can also be a so-called remote control section making use of typically infrared rays and other electrical waves. As another alternative, the input section 915 can also be the externally connected apparatus 929 provided for operating the acoustic control apparatus 10. Typical examples of the externally connected apparatus 929 are a mobile phone and a PDA (Personal Digital Assistant). As a further alternative, the input section 915 is configured as typically an input control circuit for generating an input signal on the basis of information entered by the user typically by operating the operation section and supplying the signal to the CPU 901. The user of the acoustic control apparatus 10 operates the input section 915 in order to enter various kinds of data to the acoustic control apparatus 10 and request the acoustic control apparatus 10 to carry out a processing operation.

The output section 917 is a section for visually or aurally informing the user of information. The output section 917 may be a CRT (Cathode Ray Tube) display section, a liquid-crystal display section, a plasma display section, an EL (Electroluminescent) display section, a lamp display section, a sound outputting section such as a speaker or a head phone, a printer, a mobile phone and a facsimile. The output section 917 typically outputs results of various kinds of processing carried out by the acoustic control apparatus 10. To put it concretely, the display section shows the results of various kinds of processing carried out by the acoustic control apparatus 10 as a text or an image. On the other hand, the sound outputting section converts an audio signal representing reproduced audio data and reproduced acoustic data into an analog signal and outputs the analog signal.

The storage section 919 is a typical storage section employed in the acoustic control apparatus 10. The storage section 919 is a memory used for storing data. Typical examples of the storage section 919 are a magnetic storage device such as an HDD (Hard Disk Drive), a semiconductor storage device, an optical storage device and a magneto-optical storage device. To be more specific, the storage section 919 is used for storing a variety of programs to be executed by the CPU 901, various kinds of data generated internally and various kinds of data received from external sources.

The drive 921 is a reader drive for the removable recording medium 927 mounted on the drive 921. The drive 921 can be embedded in the acoustic control apparatus 10 or connected externally to the acoustic control apparatus 10. The removable recording medium 927 mounted on the drive 921 can be a magnetic disk, an optical disk, a magneto-optical disk or a semiconductor memory. The drive 921 reads out information from the removable recording medium 927 and supplies the information to the RAM 905. In addition, with the removable recording medium 927 mounted on the drive 921, the drive 921 is also capable of writing records onto the removable recording medium 927. Typical examples of the removable recording medium 927 are DVD media, HD-DVD (High-Definition Digital Versatile Disk) media and Blu-ray media. Other typical examples of the removable recording medium 927 are a CF (Compact Flash which is a registered trademark) and an SD (Secure Digital) memory card. Further typical examples of the removable recording medium 927 are an IC (Integrated Circuit) card and an electronic device. The IC card has noncontact IC chips mounted thereon.

The connection port 923 is a port for connecting an external apparatus directly to the acoustic control apparatus 10. Typical examples of the connection port 923 are a USB (Universal Serial Bus) port, an IEEE1394 port and an SCSI (Small Computer System Interface) port. Other typical examples of the connection port 923 are an RS-232C port, an optical audio terminal and an HDMI (High-Definition Multi Media Interface) port. With the externally connected apparatus 929 connected to the connection port 923, the acoustic control apparatus 10 is capable of acquiring various kinds of input data from the externally connected apparatus 929 and providing various kinds of output data to the externally connected apparatus 929.

The communication section 925 is a communication interface configured as a communication device to be connected to a communication network 931. The communication section 925 is typically a communication card for wire and radio LAN (Local Area Network) communications, Bluetooth (a registered trademark) communications or WUSB (Wireless USB) communications. In addition, the communication section 925 can be an optical communication router, an ADSL (Asymmetric Digital Subscriber Line) router or a modem provided for various kinds of communication. The communication section 925 is capable of exchanging signals and the like with the Internet and other communication apparatus in conformity with a predetermined protocol such as the TCP/IP (Transmission Control Protocol/Internet Protocol). In addition, the communication network 931 connected to the communication section 925 is typically configured as a network connected to the communication section 925 for wire and radio communications. Typical examples of the communication network 931 include the Internet, a home LAN, an infrared-ray communication network, a radio communication network or a satellite communication network.

The above descriptions explain a typical hardware configuration for implementing functions of the acoustic control apparatus 10 according to the embodiment of the present disclosure. Each of the configuration element can be configured by making use of a general-purpose member or hardware specially tailored to the function of the configuration element. Thus, in accordance with a technological level which is improved from time to time as a level for implementing the embodiment, the configuration of the hardware for implementing every configuration element can be changed properly.

Preferred embodiments of the present disclosure have been explained in detail by referring to diagrams. However, implementations of the present disclosure are by no means limited to the embodiments. It is obvious that a person having ordinary knowledge in the field of the technology pertaining to the present disclosure is capable of coming up with a variety of changes made to the embodiments and modified versions of the embodiments in a range of technological concepts described in claims of this specification or the present disclosure. However, such changes and such modified versions are naturally regarded to fall within the range of the technological concepts described in the claims.

The present disclosure contains subject matter related to that disclosed in Japanese Priority Patent Application JP 2010-248832 filed in the Japan Patent Office on Nov. 5, 2010, the entire content of which is hereby incorporated by reference.

What is claimed is:

1. An acoustic control apparatus comprising:

a speaker-position computation section configured to find the position of each of a plurality of speakers located in a speaker layout space on the basis of a position of a microphone in the speaker layout space based on an image of a user and sound collection carried out by the microphone, wherein the image includes at least one of the microphone and an object placed at a location close to the position of the microphone, and wherein a result of the sound collection is carried out by the microphone to collect a signal sound generated by each one of the speakers;

an image processing section configured to process the image, wherein the image processing section extracts metadata of the user in the image, and wherein the metadata of the user includes information indicating at least one of a gender of the user and an age of the user extracted based on detected characteristic portions of a face of the user in the image; and an acoustic control section configured to carry out control of a sound generated by each of the speakers by computing the position of the user in the speaker layout space on the basis of the image of the user, computing the distance between the position of the user and the position of each of the speakers, and controlling sounds generated by the speakers according to the computed distances, wherein the acoustic control section makes use of the distance between the position of the user and the position of each of the speakers in order to dynamically change positions used for setting sounds generated by the speakers, wherein the acoustic control section is further configured to adjust the quality of the sounds generated by the speakers in accordance with the extracted metadata of the user, wherein adjusting the quality of the sounds comprises carrying out predetermined surround sound equalizing with respect to the plurality of speakers in accordance with the extracted metadata of the user, and wherein the speaker-position computation section, the image processing section, and the acoustic control section are each implemented via at least one processor.

2. The acoustic control apparatus according to claim 1, wherein the speaker-position computation section finds the position of each of the speakers located in the speaker layout space on the basis of the position of the microphone, and the distance between the position of the microphone and the position of each of the speakers computed by making use of the volume of the signal sound generated by each of the speakers and collected by the microphone.

3. The acoustic control apparatus according to claim 1, wherein:

the image processing section is configured to process the image of at least the microphone and the object placed at the location close to the position of the microphone;

the image processing section detects the face of the user approaching the microphone as the object placed at the location close to the position of the microphone.

4. The acoustic control apparatus according to claim 1, wherein:

the image processing section is configured to process the image of at least the microphone and the object placed at the location close to the position of the microphone;

the image processing section detects the microphone or a visual marker provided on the microphone.

5. The acoustic control apparatus according to claim 1, wherein the speaker-position computation section finds the position of each of the speakers on the basis of a result of collection of signal sounds output from the speakers and collected by making use of one of a monaural microphone, a stereo microphone and a multi-channel microphone.

6. The acoustic control apparatus according to claim 1, wherein the detected characteristic portions of the face of the user include brows, eyes, nose, and mouth of the user.

7. The acoustic control apparatus according to claim 1, wherein the image processing section further extracts a gesture made by the user shown in the image.

8. The acoustic control apparatus according to claim 1, wherein the image processing section further extracts metadata of a plurality of users shown in the image.

9. The acoustic control apparatus according to claim 8, wherein adjusting the quality of the sounds further comprises carrying out predetermined surround sound equalizing with respect to the plurality of speakers in accordance with the extracted metadata of the plurality of users.

10. An acoustic control method, implemented via at least one processor, the method comprising:

computing the position of a microphone in a speaker layout space, in which a plurality of speakers are laid out, based on an image of a user and sound collection carried out by the microphone, wherein the image includes at least one of the microphone and an object placed at a location close to the position of the microphone;

finding the position of each of the plurality of speakers laid out in the speaker layout space based on the computed position of the microphone and a result of the sound collection carried out by the microphone to collect signal sounds, each signal sound generated by one of the speakers;

processing the image to extract metadata of the user in the image, wherein the metadata of the user includes information indicating at least one of a gender of the user and an age of the user extracted based on detected characteristic portions of a face of the user in the image; and controlling a sound generated by each of the speakers in accordance with the computed position of the user and the distance from the position of the user to the position of each of the speakers using the distance between the position of the user and the position of each of the speakers in order to dynamically change positions used for setting sounds generated by the speakers and setting sounds generated by the speakers; and adjusting the quality of the sounds generated by the speakers in accordance with the extracted metadata of the user, wherein adjusting the quality of the sounds comprises carrying out predetermined surround sound equalizing with respect to the plurality of speakers in accordance with the extracted metadata of the user.

11. The acoustic control method according to claim 10, wherein the characteristic portions of the face of the user include brows, eyes, nose, and mouth of the user.

12. The acoustic control method according to claim 10, wherein the image processing section further extracts a gesture made by the user shown in the image.

13. The acoustic control method according to claim 10, wherein the image processing section further extracts metadata of a plurality of users shown in the image.

14. The acoustic control method according to claim 13, wherein adjusting the quality of the sounds further comprises carrying out predetermined surround sound equalizing with respect to the plurality of speakers in accordance with the extracted metadata of the plurality of users.

* * * * *